US010377529B2

(12) United States Patent
Apps

(10) Patent No.: US 10,377,529 B2
(45) Date of Patent: Aug. 13, 2019

(54) STACKABLE LOW DEPTH TRAY

(71) Applicant: Rehrig Pacific Company, Los Angeles, CA (US)

(72) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 165 days.

(21) Appl. No.: 15/332,436

(22) Filed: Oct. 24, 2016

(65) Prior Publication Data

US 2017/0129647 A1 May 11, 2017

Related U.S. Application Data

(63) Continuation of application No. 12/573,409, filed on Oct. 5, 2009, now Pat. No. 9,475,602.

(60) Provisional application No. 61/102,955, filed on Oct. 6, 2008.

(51) Int. Cl.

| | |
|---|---|
| ***B65D 21/02*** | (2006.01) |
| ***B65D 71/70*** | (2006.01) |
| ***B65D 1/24*** | (2006.01) |
| ***B65D 71/52*** | (2006.01) |

(52) U.S. Cl.

CPC ..... *B65D 21/0233* (2013.01); *B65D 1/243* (2013.01); *B65D 71/0003* (2013.01); *B65D 71/70* (2013.01); *B65D 2501/2407* (2013.01); *B65D 2501/24019* (2013.01); *B65D 2501/2435* (2013.01); *B65D 2501/24108* (2013.01); *B65D 2501/24216* (2013.01); *B65D 2501/24222* (2013.01); *B65D 2501/24235* (2013.01); *B65D 2501/24267* (2013.01); *B65D 2501/24541* (2013.01); *B65D 2501/24719* (2013.01); *B65D 2501/24853* (2013.01)

(58) Field of Classification Search

CPC ..... B65D 21/0233; B65D 1/243; B65D 71/0003; B65D 71/70

See application file for complete search history.

(56) References Cited

U.S. PATENT DOCUMENTS

| | | | |
|---|---|---|---|
| D103,862 | S | 8/1936 | Randall et al. |
| 2,411,673 | A | 11/1946 | Vechey, Jr. |
| D147,981 | S | 11/1947 | Lehman |
| D152,907 | S | 3/1949 | Richards |
| 2,512,855 | A | 6/1950 | Erickson |

(Continued)

FOREIGN PATENT DOCUMENTS

| | | | |
|---|---|---|---|
| BE | 693216 | A | 3/1967 |
| CA | 965056 | A1 | 3/1975 |

(Continued)

OTHER PUBLICATIONS

Photograph of Pepsi—Blue Crate, Top View.

(Continued)

*Primary Examiner* — Jeffrey R Allen
*Assistant Examiner* — Jennifer Castriotta
(74) *Attorney, Agent, or Firm* — Carlson, Gaskey & Olds, P.C.

(57) ABSTRACT

A tray for storing and transporting bottles includes a plurality of base walls each for supporting a bottle thereon. A plurality of interior columns extend upwardly between the base walls. Longitudinal dividers connect the interior columns. Lateral dividers connect the interior columns to side columns along side edges of the tray. At least one band extends along the side edges of the tray connecting the side columns.

20 Claims, 30 Drawing Sheets

(56) References Cited

U.S. PATENT DOCUMENTS 2,526,335 A 10/1950 Deichert
2,530,481 A 11/1950 Rawn, Jr.
2,535,493 A 12/1950 Gerber
2,588,805 A 3/1952 Cross
2,626,079 A 1/1953 Keller
D172,664 S 1/1954 Emery
2,743,030 A 4/1956 Read, Jr.
2,760,676 A 8/1956 Knieriem
2,840,256 A 6/1958 Cobb, Jr.
2,928,530 A 3/1960 Sauey
2,935,222 A 5/1960 Oconnell
2,970,715 A 2/1961 Kappel
D189,891 S 3/1961 Schillin
2,974,819 A 3/1961 Melville
2,979,222 A 4/1961 Levine
3,009,579 A 11/1961 Ettlinger, Jr.
3,055,531 A 9/1962 De Chelbor
3,055,542 A 9/1962 Russo
3,092,284 A 6/1963 Stout
D195,702 S 7/1963 Russo
3,106,308 A 10/1963 Kazimier
3,151,762 A 10/1964 Vidal
3,155,268 A 11/1964 Fogerty
3,184,148 A 5/1965 Poupitch
D201,257 S 6/1965 Vidal
3,247,996 A 4/1966 Garcia
3,283,947 A 11/1966 Cornelius
3,297,190 A 1/1967 Cloyd
D208,111 S 7/1967 Vidal
3,332,574 A 7/1967 Earp
3,333,727 A 8/1967 Belcher
3,333,729 A 8/1967 Rabb
3,334,767 A 8/1967 Cornelius
3,349,943 A 10/1967 Box
D209,864 S 1/1968 Vesteeg
3,376,998 A 4/1968 Cornelius
3,384,261 A 5/1968 Austin
3,390,801 A 7/1968 Adomat
3,391,814 A 7/1968 Box
3,391,815 A 7/1968 Box
3,392,869 A 7/1968 Needt
3,416,694 A 12/1968 Bebb
3,428,207 A 2/1969 Schoeller
3,517,852 A 6/1970 Schoeller
3,628,684 A 12/1971 Sere
3,638,824 A 2/1972 Sekiguchi
3,701,449 A 10/1972 Schoeller
3,759,416 A 9/1973 Constantine
D229,674 S 12/1973 Quigg
3,788,002 A 1/1974 Suchka
3,812,996 A 5/1974 Bunnell
3,865,239 A 2/1975 Herolzer et al.
D239,213 S 3/1976 Carroll
3,949,876 A 4/1976 Bridges et al.
3,991,879 A 11/1976 Hirota
3,998,328 A 12/1976 Box
29,262 A 6/1977 Utz
4,027,796 A 6/1977 Martin
4,037,722 A 7/1977 Bremer
4,040,517 A 8/1977 Torokvei
4,071,162 A 1/1978 Steinlein et al.
4,095,720 A 6/1978 Delbrouck et al.
4,101,049 A 7/1978 Wallace et al.
4,161,259 A 7/1979 Palafox
4,162,738 A 7/1979 Wright
4,202,448 A 5/1980 Jaeger et al.
4,204,596 A 5/1980 Davis
4,295,576 A 10/1981 Steinlein
4,308,966 A 1/1982 Ettema et al.
4,319,685 A 3/1982 David
4,344,530 A 8/1982 deLarosiere
D266,709 S 10/1982 Box
D268,791 S 4/1983 Wood
4,387,824 A 6/1983 Wefers
4,410,099 A 10/1983 deLarosiere
4,416,373 A 11/1983 deLarosiere
D275,142 S 8/1984 Torokvei
4,538,742 A 9/1985 Prodel
4,548,320 A 10/1985 Box
D283,103 S 3/1986 Cushing et al.
4,585,137 A 4/1986 Poutiainen et al.
D284,841 S 7/1986 Rowland et al.
4,615,444 A 10/1986 de Larosiere
D289,938 S 5/1987 Warwick
D291,178 S 8/1987 Toms
4,700,836 A 10/1987 Hammett
4,700,837 A 10/1987 Hammett
D295,107 S 4/1988 Frost
4,773,554 A 9/1988 Warwick
4,789,063 A 12/1988 Hammett
D304,123 S 10/1989 Warwick
4,899,874 A 2/1990 Apps et al.
4,911,303 A 3/1990 Andersson
4,928,841 A 5/1990 Arthurs
4,932,532 A 6/1990 Apps et al.
4,944,400 A 7/1990 Van Onstein et al.
4,978,002 A 12/1990 Apps et al.
D313,493 S 1/1991 Apps et al.
D317,670 S 6/1991 Apps
D318,552 S 6/1991 Apps
5,031,774 A 7/1991 Morris et al.
5,035,326 A 7/1991 Stahl
D319,129 S 8/1991 Apps et al.
5,040,681 A 8/1991 Grusin
D320,298 S 9/1991 Apps et al.
5,060,819 A 10/1991 Apps
5,071,026 A 12/1991 Apps
5,078,282 A 1/1992 Stanfield
5,096,085 A 3/1992 Eek et al.
D325,279 S 4/1992 Apps
5,105,948 A 4/1992 Morris et al.
D326,749 S 6/1992 Apps et al.
D327,357 S 6/1992 Rehrig
D327,972 S 7/1992 Apps et al.
D329,931 S 9/1992 Apps
D329,932 S 9/1992 Apps
5,184,748 A 2/1993 Apps
5,213,211 A 5/1993 Umiker
5,267,649 A 12/1993 Apps et al.
5,287,966 A 2/1994 Stahl
5,305,884 A 4/1994 Apps et al.
5,316,172 A 5/1994 Apps et al.
5,320,245 A 6/1994 Apps et al.
5,335,814 A 8/1994 Hepp
D350,438 S 9/1994 Apps et al.
5,351,814 A 10/1994 Apps
5,377,862 A 1/1995 Oakes et al.
D356,679 S 3/1995 Apps et al.
5,405,042 A 4/1995 Apps et al.
5,419,451 A 5/1995 Bitel, Jr.
5,421,477 A 6/1995 Hammett
D360,758 S 8/1995 Umiker
D361,431 S 8/1995 Koefelda
5,465,843 A 11/1995 Koefelda
5,487,487 A 1/1996 Hammett
5,495,945 A 3/1996 Apps et al.
5,501,352 A 3/1996 Apps
5,529,176 A 6/1996 Apps
5,575,390 A 11/1996 Apps et al.
D378,249 S 3/1997 Apps et al.
D379,121 S 5/1997 Apps et al.
D379,717 S 6/1997 Apps et al.
D380,613 S 7/1997 Apps et al.
D380,901 S 7/1997 Apps et al.
5,651,461 A 7/1997 Apps et al.
5,660,279 A 8/1997 Apps
5,669,498 A 9/1997 Fierek et al.
5,702,022 A 12/1997 Umiker
5,704,482 A 1/1998 Apps et al.
5,740,934 A 4/1998 Brady
5,769,230 A 6/1998 Koefelda
D395,954 S 7/1998 Apps et al.
D398,152 S 9/1998 Kelly
D399,060 S 10/1998 Apps et al.

(56) References Cited

U.S. PATENT DOCUMENTS

| | | | |
|---|---|---|---|
| D400,012 | S | 10/1998 | Apps |
| 5,823,376 | A | 10/1998 | McGrath |
| D401,764 | S | 12/1998 | Apps et al. |
| 5,842,572 | A | 12/1998 | Apps et al. |
| D404,204 | S | 1/1999 | Apps |
| 5,855,277 | A | 1/1999 | Apps et al. |
| 5,881,902 | A | 3/1999 | Ackermann |
| 5,896,992 | A | 4/1999 | McGrath |
| D410,778 | S | 6/1999 | Apps et al. |
| D412,399 | S | 8/1999 | Apps et al. |
| 5,964,343 | A | 10/1999 | Steiner |
| 5,971,204 | A | 10/1999 | Apps |
| 5,979,654 | A | 11/1999 | Apps |
| D417,784 | S | 12/1999 | Umiker |
| 6,006,912 | A | 12/1999 | McGrath |
| 6,047,844 | A | 4/2000 | McGrath |
| 6,059,109 | A | 5/2000 | Stein |
| 6,073,793 | A | 6/2000 | Apps et al. |
| 6,079,554 | A | 6/2000 | Hammett et al. |
| 6,112,938 | A | 9/2000 | Apps |
| 6,131,730 | A | 10/2000 | Hsu |
| D420,220 | S | 12/2000 | Apps et al. |
| 6,186,328 | B1 | 2/2001 | Apps |
| 6,189,734 | B1 | 2/2001 | Apps et al. |
| 6,237,758 | B1 | 5/2001 | Hsu |
| D446,015 | S | 8/2001 | Apps |
| 6,401,960 | B1 | 6/2002 | Hammett |
| D461,957 | S | 8/2002 | Hammett |
| D462,522 | S | 9/2002 | Apps et al. |
| 6,454,120 | B1 | 9/2002 | Hammett |
| 6,457,599 | B1 | 10/2002 | Apps et al. |
| D465,417 | S | 11/2002 | Apps |
| D466,018 | S | 11/2002 | Apps |
| D468,634 | S | 1/2003 | Hammett |
| 6,557,718 | B1 | 5/2003 | Cesano |
| D483,946 | S | 12/2003 | Koefelda |
| D485,756 | S | 1/2004 | Apps |
| D487,634 | S | 3/2004 | Apps et al. |
| 6,749,065 | B1 | 6/2004 | Hammett |
| D494,867 | S | 8/2004 | Apps |
| 6,851,563 | B1 | 2/2005 | Lipari |
| D505,014 | S | 5/2005 | Apps et al. |
| 6,886,710 | B2 | 5/2005 | Vema et al. |
| 6,892,885 | B2 | 5/2005 | Apps et al. |
| 6,899,247 | B1 | 5/2005 | Koefelda et al. |
| D507,880 | S | 8/2005 | Hassell et al. |
| 6,966,442 | B2 | 11/2005 | Hassell et al. |
| 7,011,215 | B2 | 3/2006 | Meissen et al. |
| 7,017,746 | B2 | 3/2006 | Apps |
| 7,036,666 | B2 | 5/2006 | Hammett |
| 7,086,531 | B2 | 8/2006 | Apps et al. |
| 7,093,715 | B1 | 8/2006 | Apps |
| 7,097,033 | B2 | 8/2006 | Koefelda et al. |
| 7,128,234 | B2 | 10/2006 | Apps et al. |
| 7,207,458 | B1 | 4/2007 | Koefelda et al. |
| 7,252,196 | B1 | 8/2007 | Koefelda et al. |
| 7,281,641 | B2 | 10/2007 | Apps |
| 7,311,217 | B2 | 12/2007 | Apps |
| 7,322,475 | B2 | 1/2008 | Hassell et al. |
| 7,322,486 | B2 | 1/2008 | Koefelda et al. |
| 7,549,539 | B2 | 6/2009 | Apps |
| 7,604,122 | B2 | 10/2009 | Apps et al. |
| 7,658,278 | B2 | 2/2010 | Apps et al. |
| 7,677,405 | B2 | 3/2010 | Apps et al. |
| 7,694,839 | B2 | 4/2010 | Koefelda et al. |
| D615,758 | S | 5/2010 | Lindstrom |
| 7,735,676 | B2 | 6/2010 | Ogburn |
| 7,743,939 | B2 | 6/2010 | Stahl |
| 7,950,521 | B2 | 5/2011 | Apps |
| 8,056,753 | B2 | 11/2011 | Koefelda et al. |
| 8,109,408 | B2 | 2/2012 | Hassell |
| 8,123,034 | B2 | 2/2012 | Apps et al. |
| 8,200,445 | B2 | 6/2012 | Kashiwakura |
| 8,672,161 | B2 | 3/2014 | Apps |
| 8,720,688 | B2 | 5/2014 | Hassell et al. |
| 9,010,536 | B2 | 4/2015 | McCanless et al. |
| 2001/0015329 | A1 | 8/2001 | Apps et al. |
| 2001/0019063 | A1 | 9/2001 | Apps |
| 2002/0148837 | A1 | 10/2002 | Apps |
| 2002/0195452 | A1 | 12/2002 | Apps |
| 2003/0024844 | A1 | 2/2003 | Hammett |
| 2003/0029870 | A1 | 2/2003 | Apps et al. |
| 2003/0057211 | A1 | 3/2003 | Koefelda et al. |
| 2003/0075546 | A1 | 4/2003 | Hammett |
| 2005/0017063 | A1 | 1/2005 | Noone et al. |
| 2005/0067314 | A1 | 3/2005 | Koefelda et al. |
| 2005/0072710 | A1 | 4/2005 | Hammett et al. |
| 2005/0279651 | A1 | 12/2005 | Perret et al. |
| 2006/0169620 | A1 | 8/2006 | Apps |
| 2007/0187276 | A1 | 8/2007 | Stahl |
| 2007/0246392 | A1 | 10/2007 | Stahl |
| 2008/0116214 | A1 | 5/2008 | Apps et al. |
| 2009/0206088 | A1 | 8/2009 | Ogburn |
| 2009/0242568 | A1 | 10/2009 | Apps |
| 2010/0084297 | A1 | 4/2010 | Apps |
| 2010/0084302 | A1 | 4/2010 | Apps |
| 2010/0170823 | A1 | 7/2010 | Koefelda et al. |
| 2010/0258467 | A1 | 10/2010 | Apps |
| 2011/0056861 | A1 | 3/2011 | Apps |
| 2011/0240659 | A1 | 10/2011 | Orgeldinger |
| 2012/0152789 | A1 | 6/2012 | Apps et al. |
| 2013/0213855 | A1 | 8/2013 | Orgeldinger et al. |
| 2015/0014200 | A1 | 1/2015 | Apps et al. |

FOREIGN PATENT DOCUMENTS

| | | | |
|---|---|---|---|
| CA | 1109433 | A1 | 9/1981 |
| DE | 1207268 | B | 12/1965 |
| DE | 2837910 | A1 | 3/1980 |
| DE | 102007050061 | A1 | 12/2008 |
| EP | 99827 | A1 | 2/1984 |
| EP | 210712 | A2 | 2/1987 |
| EP | 464894 | A1 | 1/1992 |
| EP | 464894 | B1 | 8/1994 |
| EP | 915021 | A1 | 5/1999 |
| EP | 1008527 | A1 | 6/2000 |
| FR | 1285689 | A | 2/1962 |
| FR | 1350962 | A | 1/1964 |
| FR | 1351218 | A | 5/1964 |
| FR | 2302244 | A1 | 9/1976 |
| GB | 943947 | A | 12/1963 |
| GB | 1032916 | A | 6/1966 |
| GB | 1115343 | A | 5/1968 |
| GB | 1120067 | A | 7/1968 |
| GB | 1152038 | A | 5/1969 |
| GB | 1312701 | A | 4/1973 |
| GB | 1319726 | A | 6/1973 |
| GB | 1330778 | A | 9/1973 |
| GB | 2017645 | A | 10/1979 |
| GB | 2079256 | A | 1/1982 |
| GB | 2135278 | A | 8/1984 |
| GB | 2158044 | A | 11/1985 |
| NL | 6505562 | A | 10/1966 |
| WO | 8201536 | A1 | 5/1982 |
| WO | 9408862 | A1 | 4/1994 |
| WO | 0075027 | A1 | 12/2000 |
| WO | 2009043038 | A1 | 4/2009 |

OTHER PUBLICATIONS

Photograph of—Blue Crate, Bottom View 1.
Photograph of—Blue Crate, Bottom View 2.
Photograph of Norseman NPL 405 Crate, Top View.
Photograph of Norseman NPL 405 Crate, Bottom View.
Photograph of Coca Cola Crate, Top View.
Photograph of Coca Cola Crate, Bottom View.
Photograph of 2L Coca Cola "Tulip" Crate, Top View.
Photograph of 2L Coca Cola "Tulip" Crate, Bottom View 1.
Photograph of 2L Coca Cola "Tulip" Crate, Bottom View 2.
Photograph of 2L Coca Cola "Tulip" Crate, Bottom View 3.

STACKABLE LOW DEPTH TRAY

This application is a continuation of U.S. application Ser. No. 12/573,409, filed Oct. 5, 2009, now U.S. Pat. No. 9,475,602, which claims priority to U.S. Provisional Application Ser. No. 61/102,955, filed Oct. 6, 2008.

BACKGROUND OF THE INVENTION

The present invention relates to a stackable low depth tray for storing and transporting beverages containers, such as bottles.

Plastic bottles are widely used as containers for soft drinks and other beverages. These bottles are often stored and transported in trays, particularly plastic trays. There are many known tray designs that are referred to as "low depth" trays in which the side and end walls are lower than the height of the stored bottles, and in which the bottles support the weight of additional trays and bottles stacked thereon.

SUMMARY OF THE INVENTION

A tray according to one embodiment of the present invention includes a base having a plurality of base walls and a plurality of interior columns. A plurality of longitudinal dividers connect the interior columns to one another, and a plurality of lateral dividers extending laterally from the interior columns, such that bottle receiving pockets are separated from one another by the longitudinal dividers and the lateral dividers. A plurality of side columns are connected to one of the interior columns by one of the lateral dividers. An upper band extends along each of the side edges of the tray, the upper bands connecting the plurality of side columns on the respective side edges. A window is defined below the upper bands between each adjacent pair of side columns. The windows provide increased visibility to the bottles.

In another embodiment, a tray includes a plurality of bottle-receiving pockets and a plurality of dividers connecting the plurality of pockets to one another. An upper side band extends along a side edge of the tray, further defining at least some of the plurality of pockets. At least two of the pockets are spaced from one another such that the dividers of a similar tray on which the tray is nested can be received between the pockets.

These and other features of the application can be best understood from the following specification and drawings, the following of which is a brief description.

DETAILED DESCRIPTION OF THE PREFERRED EMBODIMENT

Figure 1:
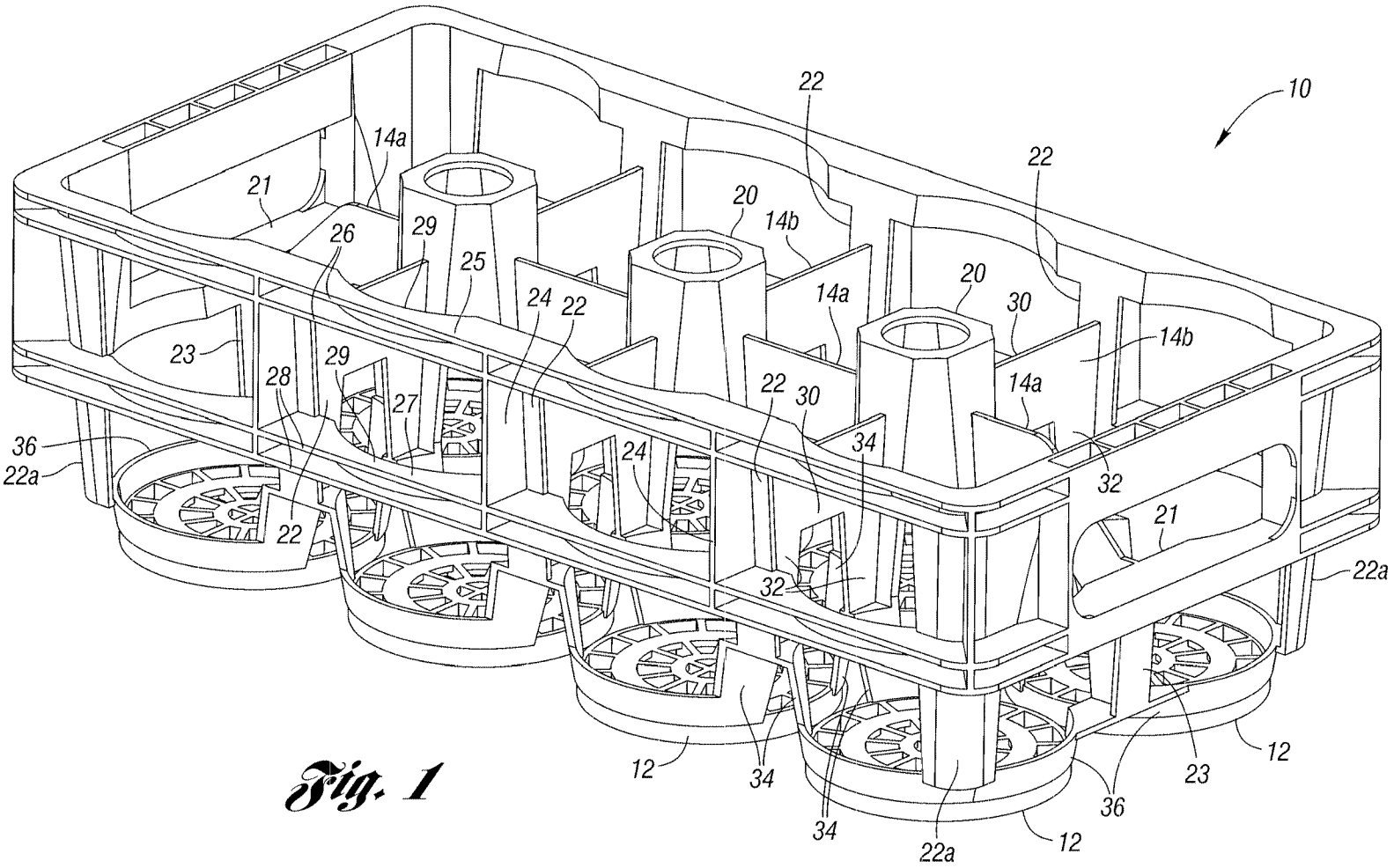
FIG. 1 is a perspective view of a tray according to one embodiment of the present invention.

A tray 10 according to one embodiment of the present invention is shown in FIG. 1. The tray 10 includes a plurality (in this example, eight) of spaced apart base walls 12. A plurality of longitudinal dividers 14*a* and a plurality of lateral dividers 14*b* (or, together "dividers 14") extend outward from a plurality of interior columns 20 which, together with the base walls 12, longitudinal dividers 14*a* and lateral dividers 14*b* define a plurality of bottle receiving pockets. The interior columns 20 are arranged generally along a longitudinal centerline of the tray 10. End longitudinal dividers 14*a* each extend from one interior column 20 to handle structures 21.

The lateral dividers 14*b* each connect one of the interior columns 20 with one of a plurality of side columns 22 positioned along a side edge of the tray 10. The side columns 22 include four corner columns 22*a* extending upwardly from the corners of the tray 10.

Each side column 22 includes a rear rib 24 protruding toward the exterior of the tray 10. The bottle-receiving pockets of the tray 10 are further defined by an upper band 25 and a lower band 27 along each side edge of the tray 10. The upper band 25 includes a pair of spaced-apart horizontal rib portions 26 connecting upper ends of the rear ribs 24 of the side columns 22. The lower band 27 includes a pair of spaced apart horizontal rib portions 28 connecting mid-portions of the rear ribs 24 of the side columns 22. The upper band 25 and lower band 27 each include an interior recess 29 aligned with each adjacent bottle receiving pocket. In this manner, an upper window opening is defined between the upper band 25, lower band 27 and adjacent side columns 22. A lower window opening is defined between the lower band 27, each base wall 12 and between adjacent side columns 22. The window openings increase product visibility.

The dividers 14 each have a lower end including two pair of spaced apart interior pocket walls 34, the interior pocket walls 34 within each pair spaced apart to connect to a different base wall 12. End pocket walls 36 protrude upwardly from ends of the end base walls 12. The pocket walls 34, 36 each have a concave interior surface and convexly curved exterior surface to define a generally cylindrical broken inner surface and a generally cylindrical broken outer surface around each base wall 12. The pocket walls 34, 36 and base walls 12 define lower pocket portions. End columns 23 connect the handle structure 21 to the end pocket walls 36 and to longitudinal dividers 14*a*.

Figure 2:
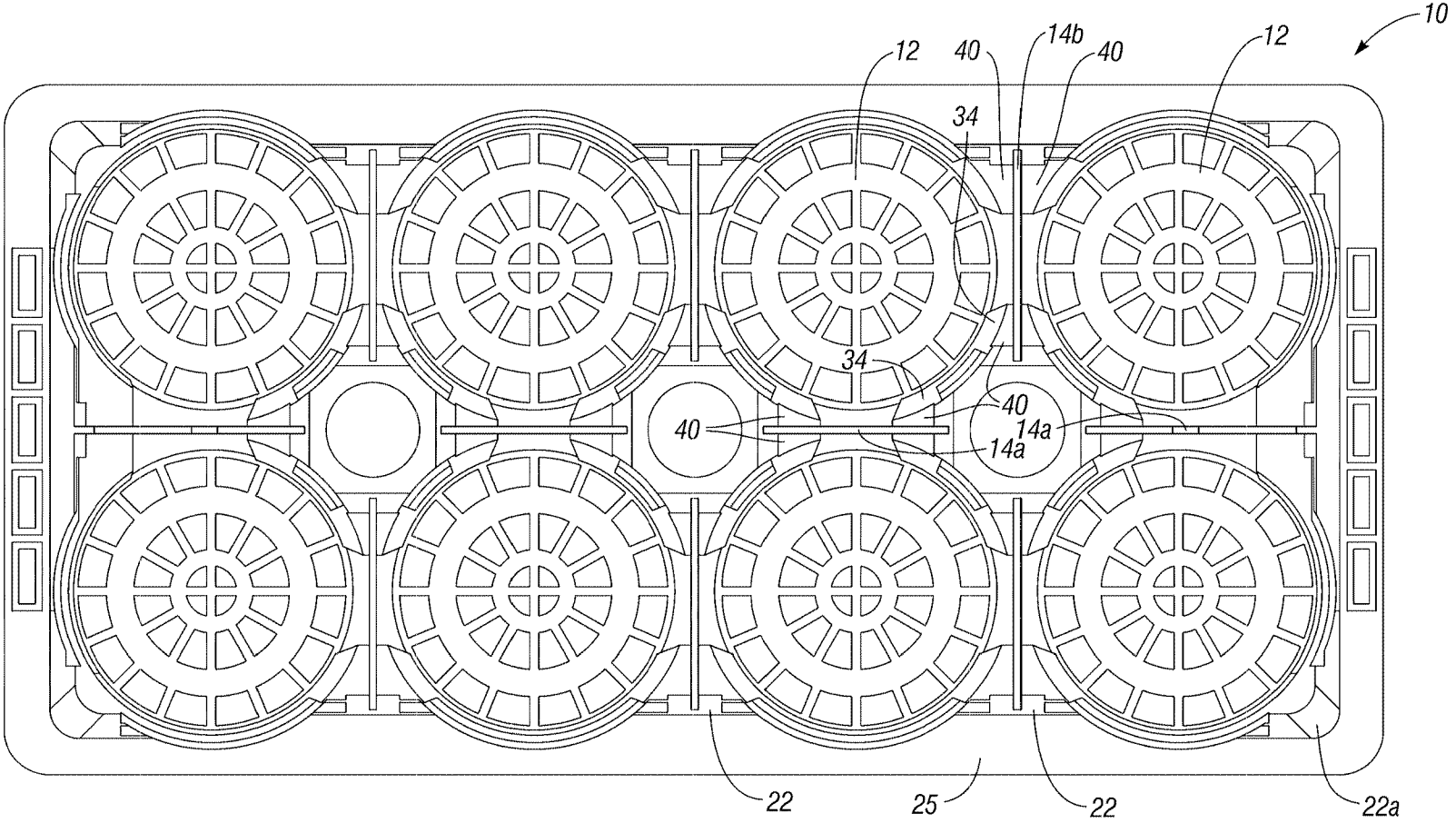
FIG. 2 is a top view of the tray of FIG. 1.

As shown in the top view of FIG. 2, the dividers 14 each include a laterally diverging wall 40 (or horizontal wall 40) from which the interior pocket walls 34 depend downwardly to the base wall 12.

Figure 3:
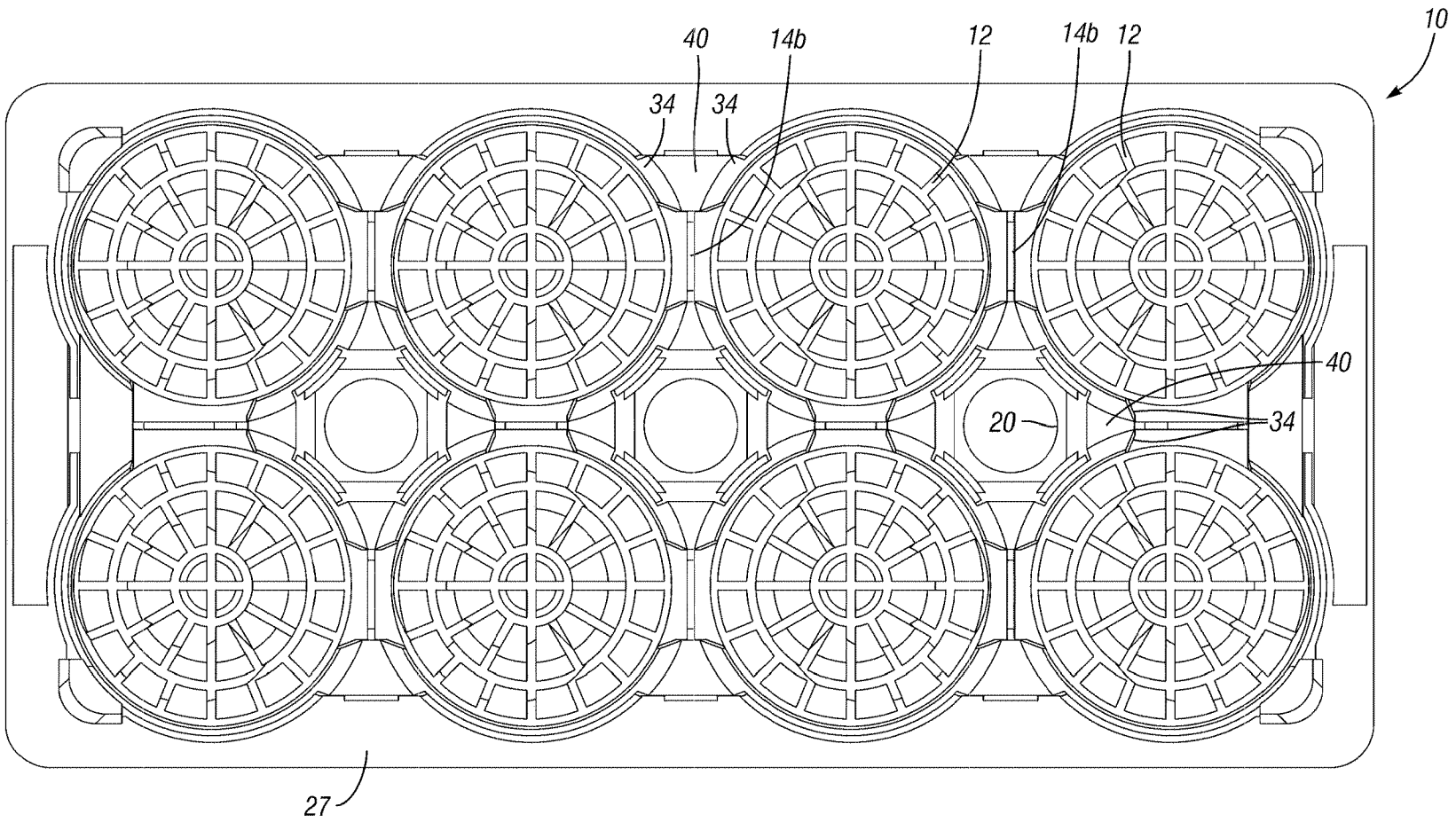
FIG. 3 is a bottom view of the tray of FIG. 2.

FIG. 3 is a bottom view of the tray 10, showing the spaced apart pocket walls 34 between the base walls 12.

Figure 4:
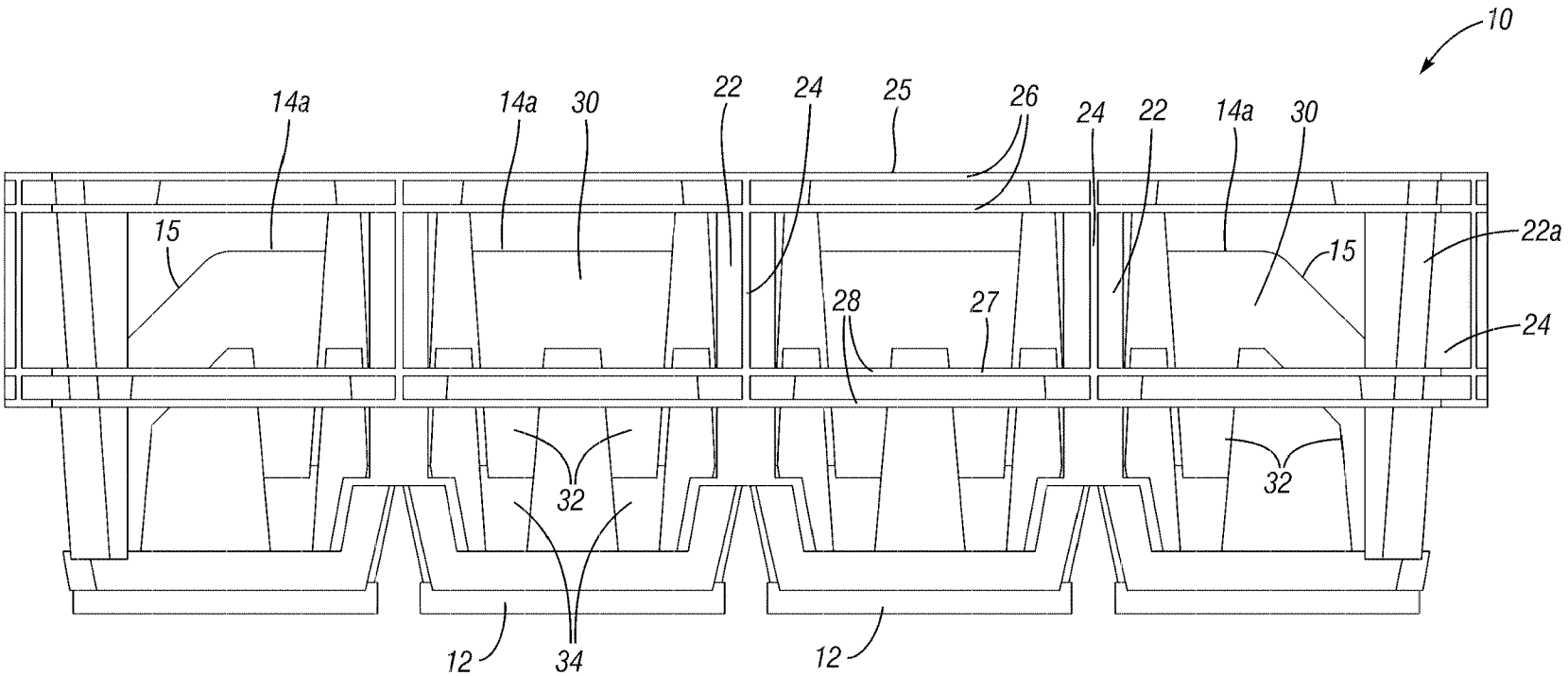
FIG. 4 is a side view of the tray.

FIG. 4 is a side view of the tray 10. Again, each side column 22 includes a rear rib 24 protruding toward the exterior of the tray 10 between the upper band 25 and the lower band 27. The horizontal rib portions 26 of the upper band 25 and horizontal rib portions 28 of the lower band 27 reinforce the side edges of the tray 10 and further define the bottle receiving pockets. The upper window openings are defined between the upper band 25, lower band 27 and adjacent side columns 22. The lower window openings are defined between the lower band 27, each base wall 12 and between adjacent side columns 22. The window openings increase product visibility, but it is not required that all of the pockets have the adjacent window openings.

Figure 5:
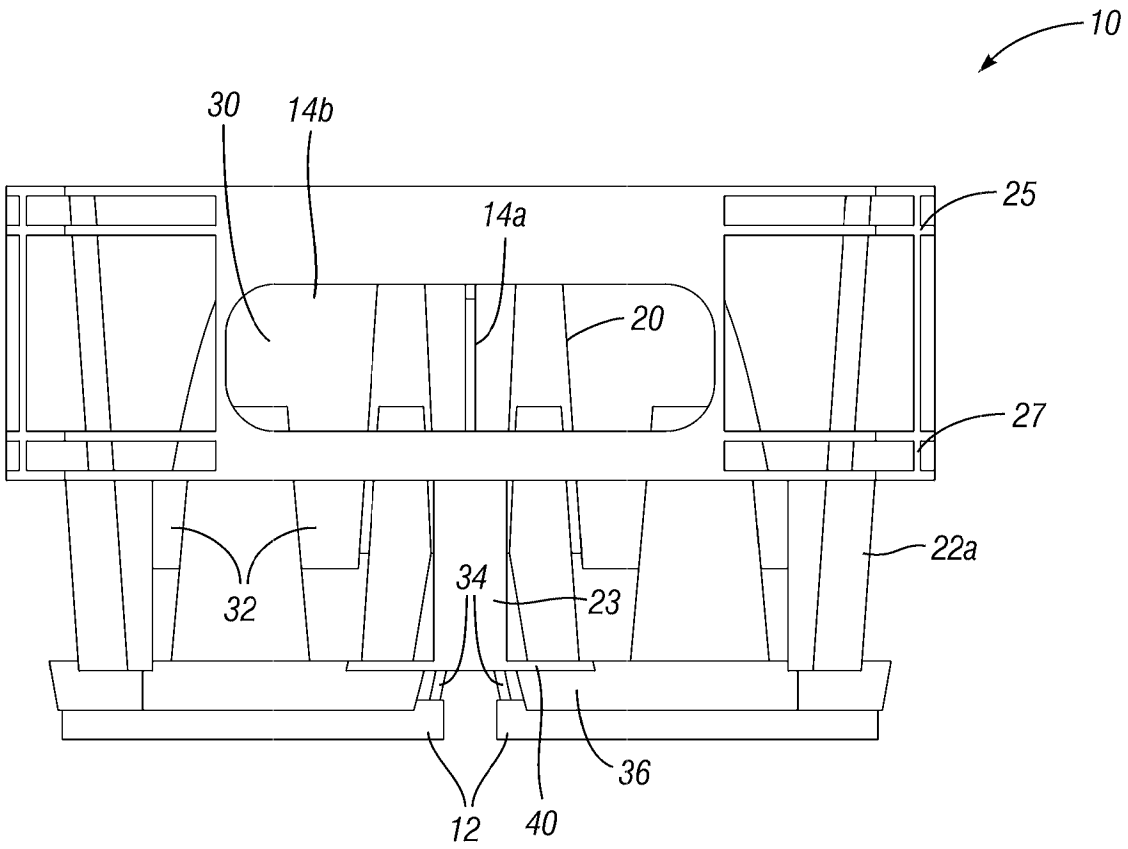
FIG. 5 is an end view of the tray.

Still referring to FIG. 4, as shown, the upper portion of each divider 14 includes a header 30 that extends directly between adjacent structures (e.g. between adjacent interior columns 20, side columns 22 and/or end columns 23 (FIG. 1)) and spaced apart leg portions 32 that are coplanar with the header portion 30. The opening formed between the leg portions 32 reduces the overall weight of the tray 10 without decreasing the rigidity, because the header portion 30 extends solidly where it is most needed. The lower end of each divider 14 then includes the two pairs of spaced apart interior pocket walls 34 extending downward to the base walls 12. (The header 30 and leg portions 32 of the longitudinal dividers 14*a* are shown in FIG. 4, while the header 30 and leg portions 32 of the lateral dividers 14*b* are shown in FIG. 1 and FIG. 5.) It would be possible to substitute one or more of the dividers 14 with solid walls or headers 30 of different sizes depending on the particular strength to weight ratio desired. As shown, the end longitudinal dividers 14*a* include tapered portions 15 that taper down toward the end columns 23.

FIG. 5 is an end view of the tray 10. As shown, the spaced apart pocket walls 34 connect the longitudinal dividers 14*a* to the base walls 12.

Figure 6:
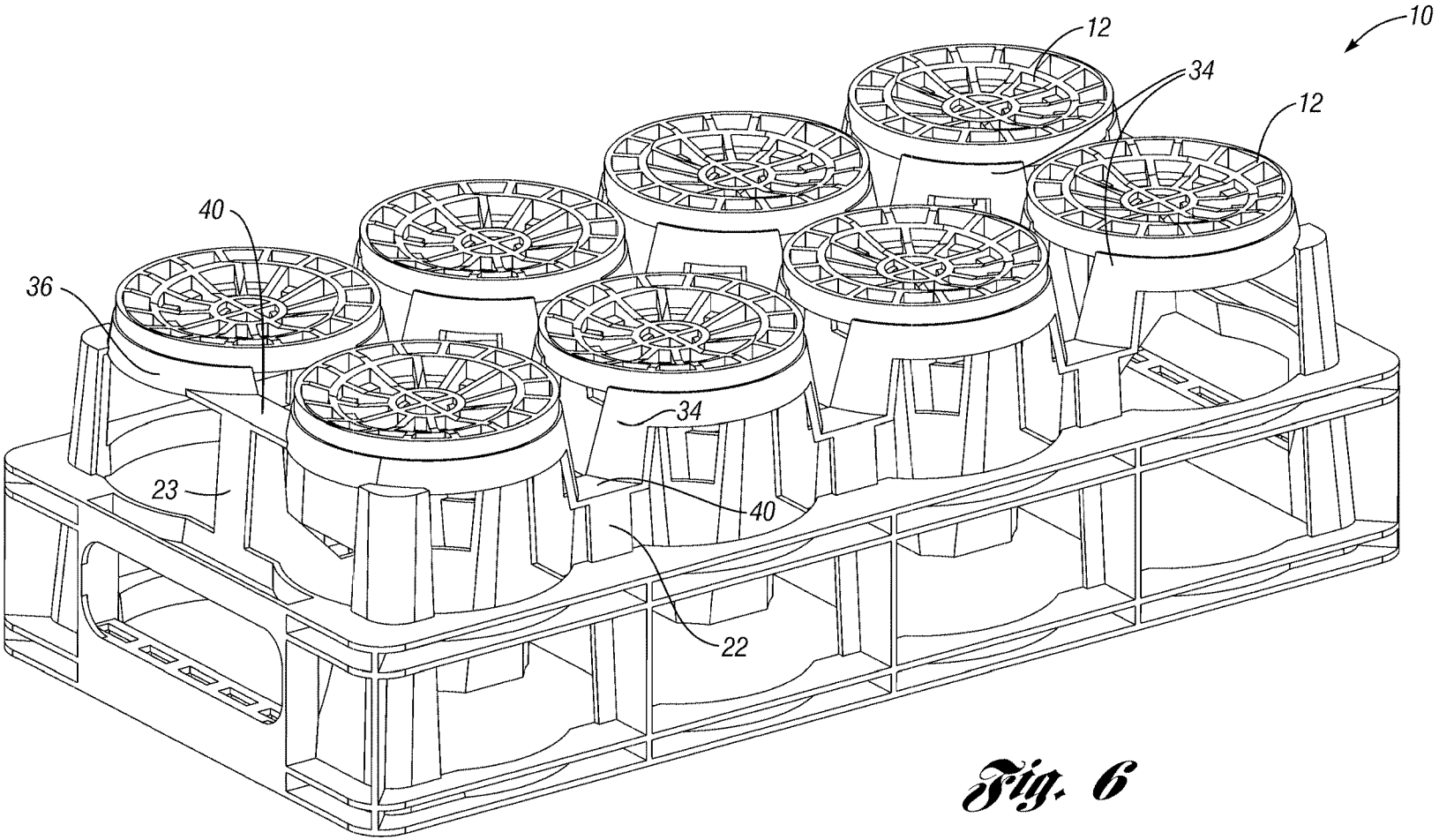
FIG. 6 is a bottom perspective view of the tray.

FIG. 6 is a bottom perspective view of the tray 10. The base walls 12 are spaced apart for the purpose of receiving therebetween the dividers 14 of a similar tray 10 on which the tray 10 is stacked. The base walls 12 are equally-spaced in the longitudinal and lateral directions. However, end columns 23 extend downward further than side columns 22, which is complementary to the downwardly tapered portions 15 of the end longitudinal dividers 14*a*.

Figure 7:
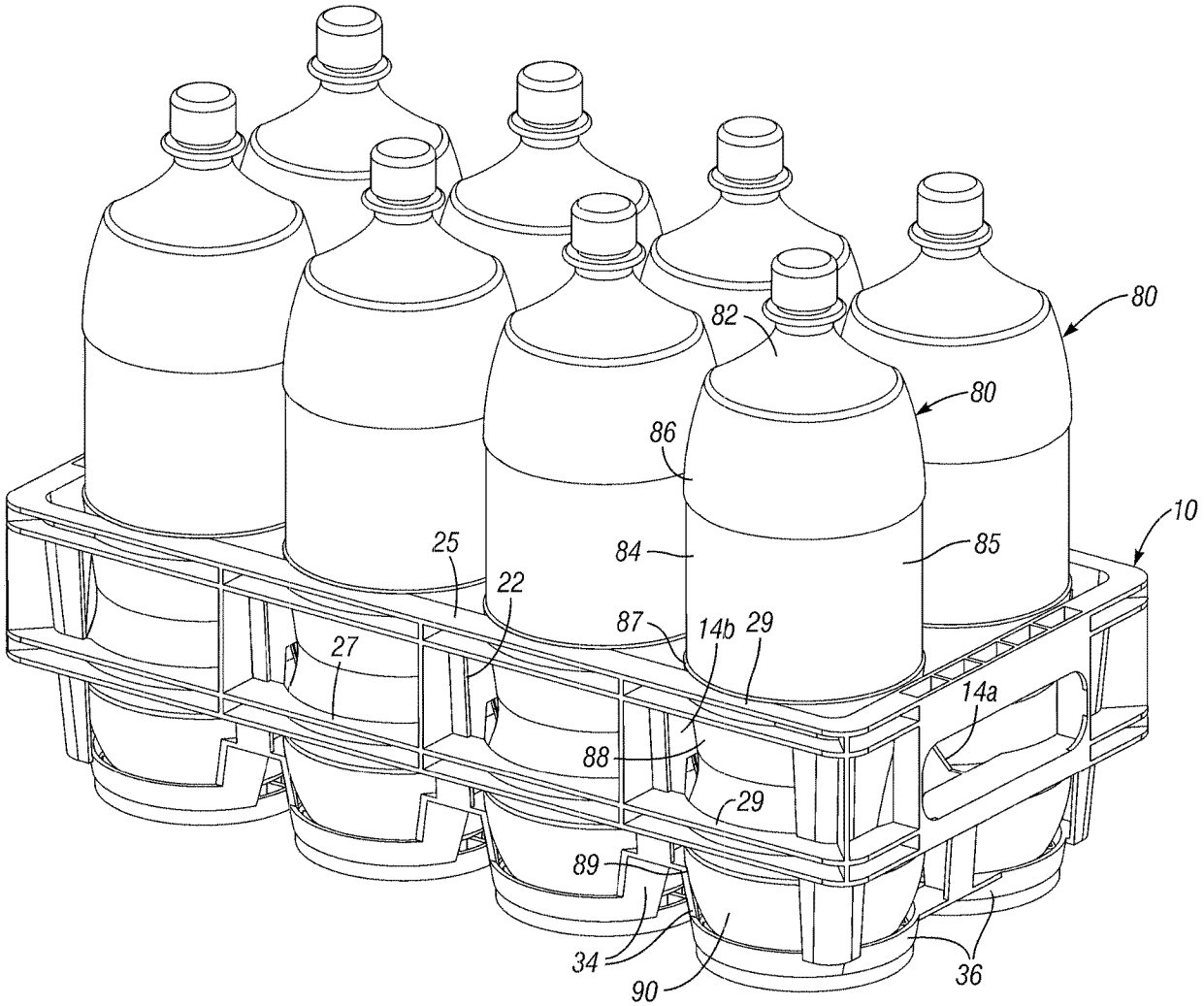
FIG. 7 is a perspective view of the tray of FIG. 1 with a plurality of bottles.

FIG. 7 is a perspective view of the tray 10 holding a plurality of bottles 80. Although other size and shape bottles 80 may be used, the tray 10 is particularly designed to hold multi-serving plastic bottles 80, such as 2-liter plastic bottles 80. The bottles 80 in this example have a neck portion 82 and a body portion 84. The body portion 84 includes a slightly recessed label area 85 having an upper label bumper portion 86 above it and a lower label bumper portion 87 below it. Below the lower label bumper portion 87 is a lower portion 88 having a heel bumper 89 below that. In some bottle designs, the lower portion 88 tapers down to a smaller diameter than the lower label bumper portion 87 and the heel bumper 89. The upper label bumper portion 86, lower label bumper portion 87 and heel bumper 89 are all nominally at a maximum diameter of the bottle 80 (subject to normal manufacturing fluctuation and fluctuation based upon pressure in the bottle 80). A tapered base 90 is formed below the heel bumper 89.

Figure 8:
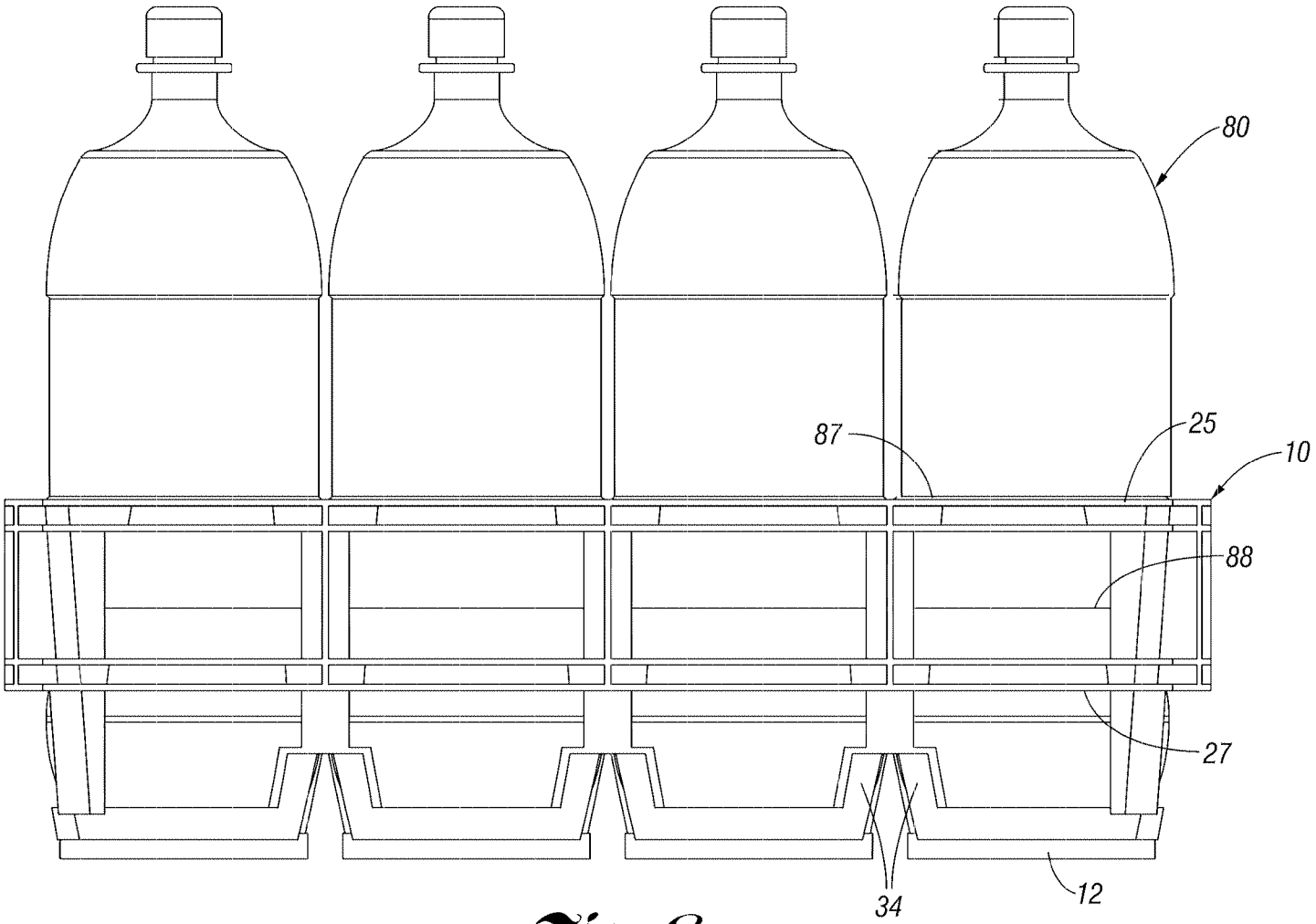
FIG. 8 is a side view of the tray and bottles of FIG. 7.

As shown in the illustrated example, the side columns 22 are tall enough so that the side columns 22 and the upper band 25 contact the lower label bumper portion 87 of the bottles 80. The base 90 of the bottle 80 is received snugly within the pocket formed by the pocket walls 34, 36. The upper and lower window openings display the bottles 80 and expose a substantial portion of the bottles 80 for view, including the lower portion 88, as shown in FIG. 8. Thus, stability and visibility of the bottles 80 is provided.

Figure 9:
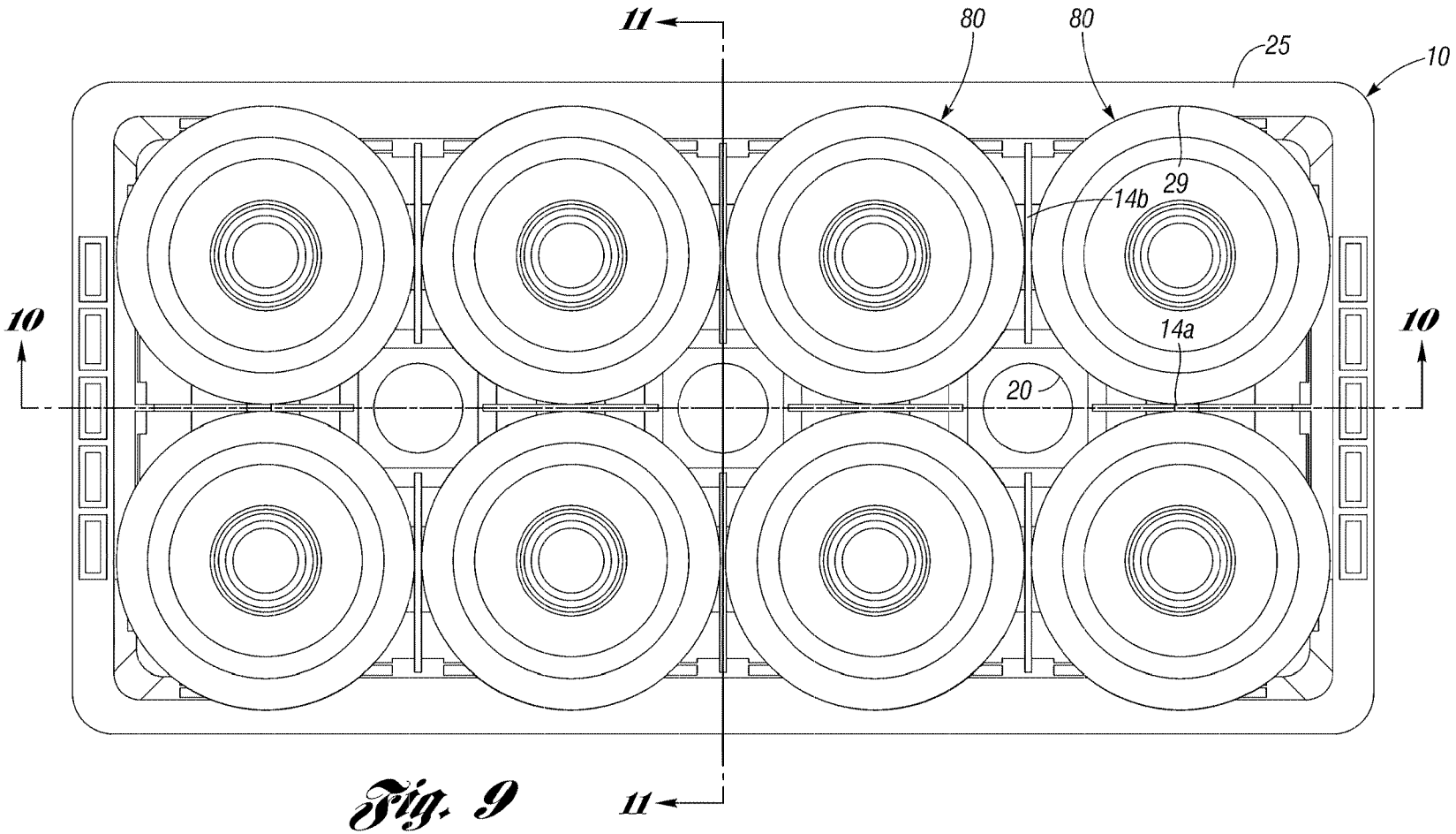
FIG. 9 is a top view of the tray and bottles of FIG. 7.
Figure 10:
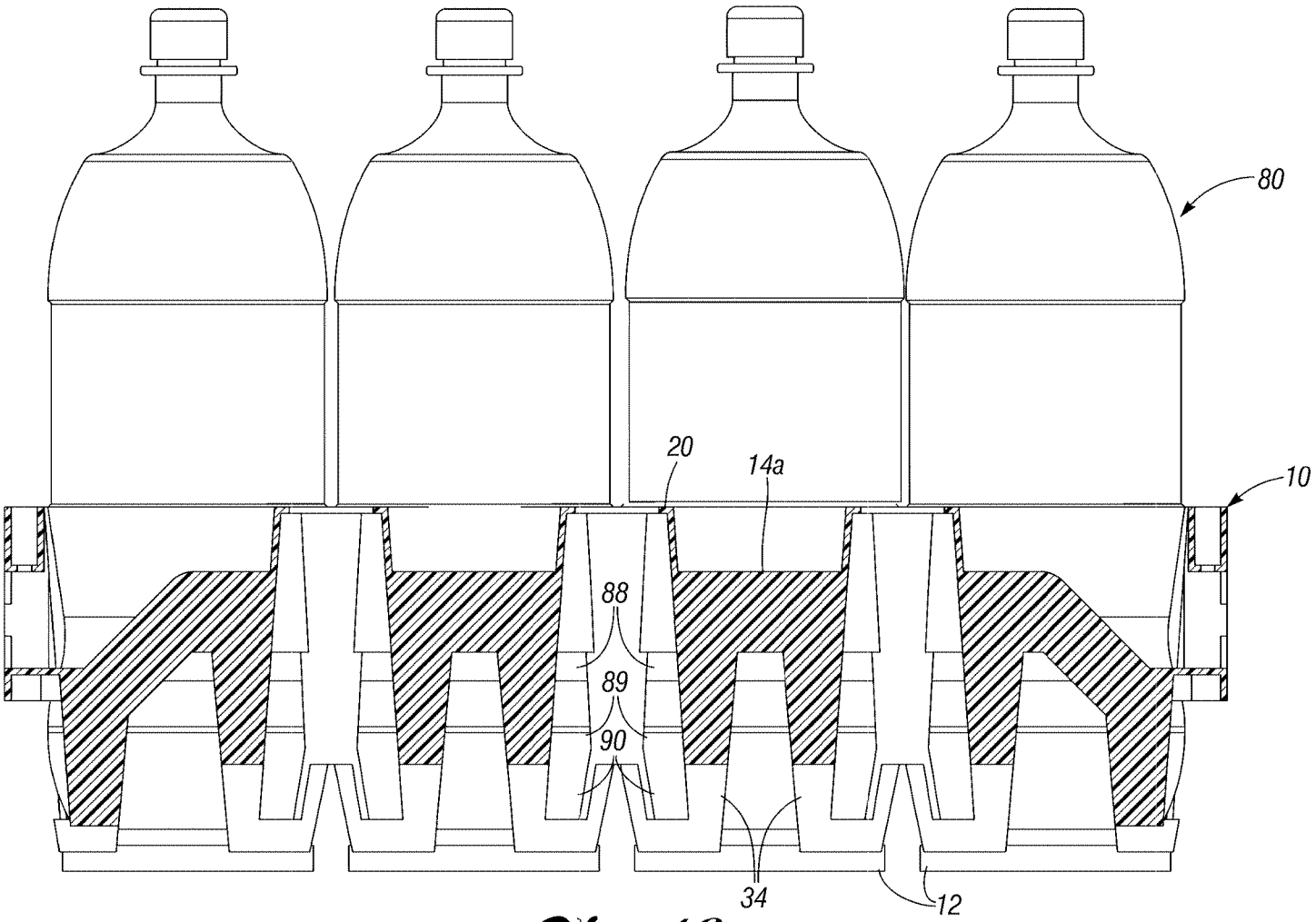
FIG. 10 is a section view taken along line 10-10 of FIG. 7.
Figure 11:
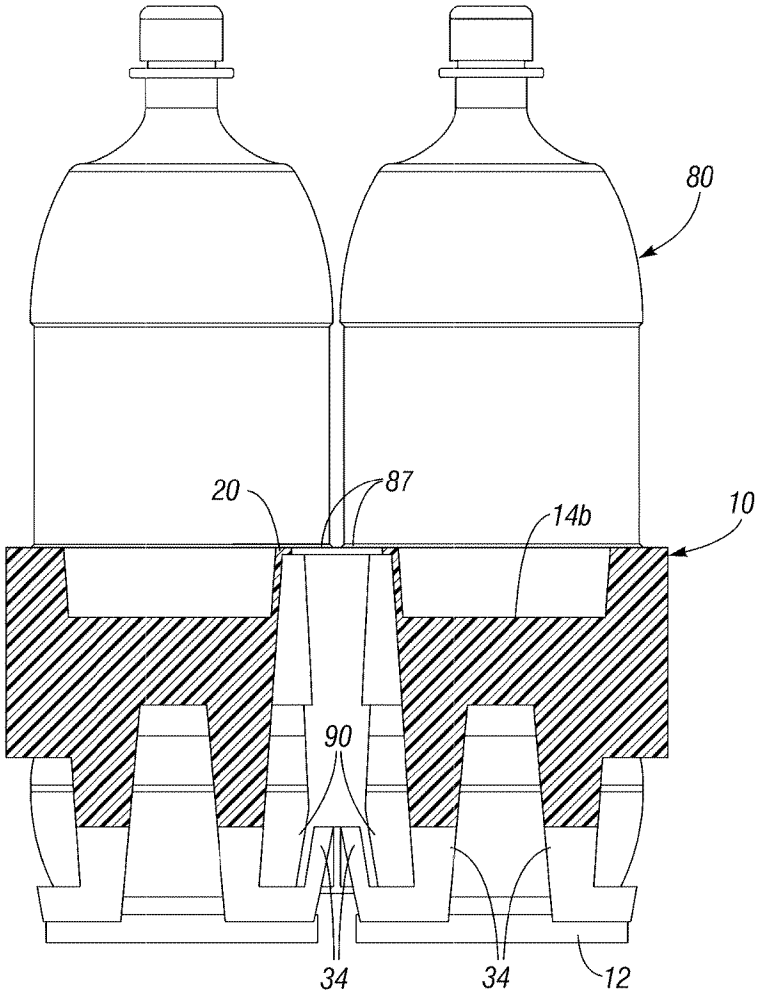
FIG. 11 is a section view taken along line 11-11 of FIG. 7.

FIG. 9 is a top view of the tray 10 and bottles 80 of FIGS. 7 and 8. FIG. 10 is a section view taken along line 10-10 of FIG. 9. As shown in FIG. 10, the spaced apart pocket walls 34 contact the base 90 of the bottles 80. The side columns 22 contact the lower label bumper portions 87 of the bottles 80. FIG. 11 is a section view taken along line 11-11 of FIG. 9. Again, the lateral dividers 14*b* connect to the base 12 via the pocket walls 34.

Figure 12:
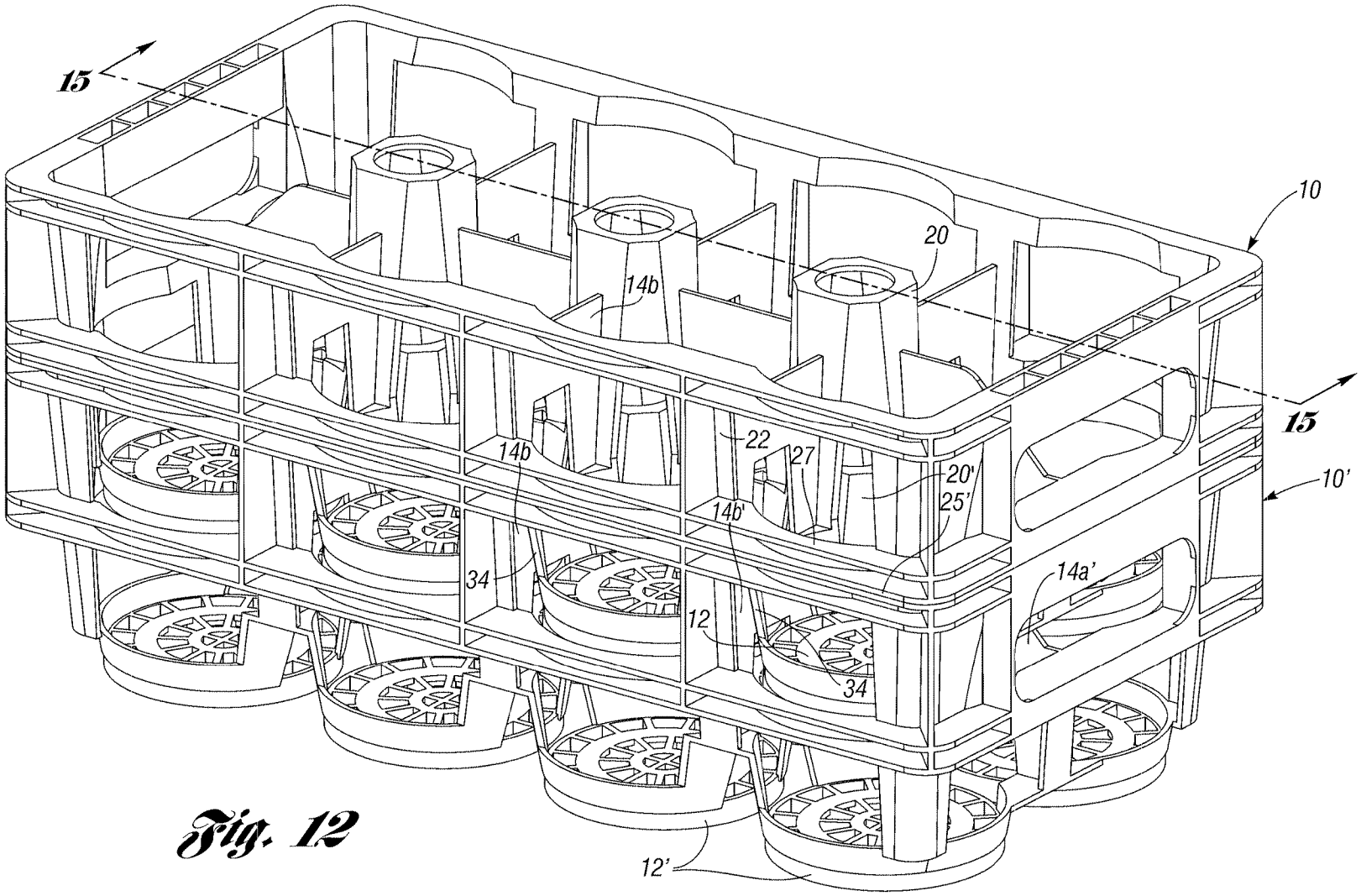
FIG. 12 is a perspective of the tray stacked on a similar tray.
Figure 13:
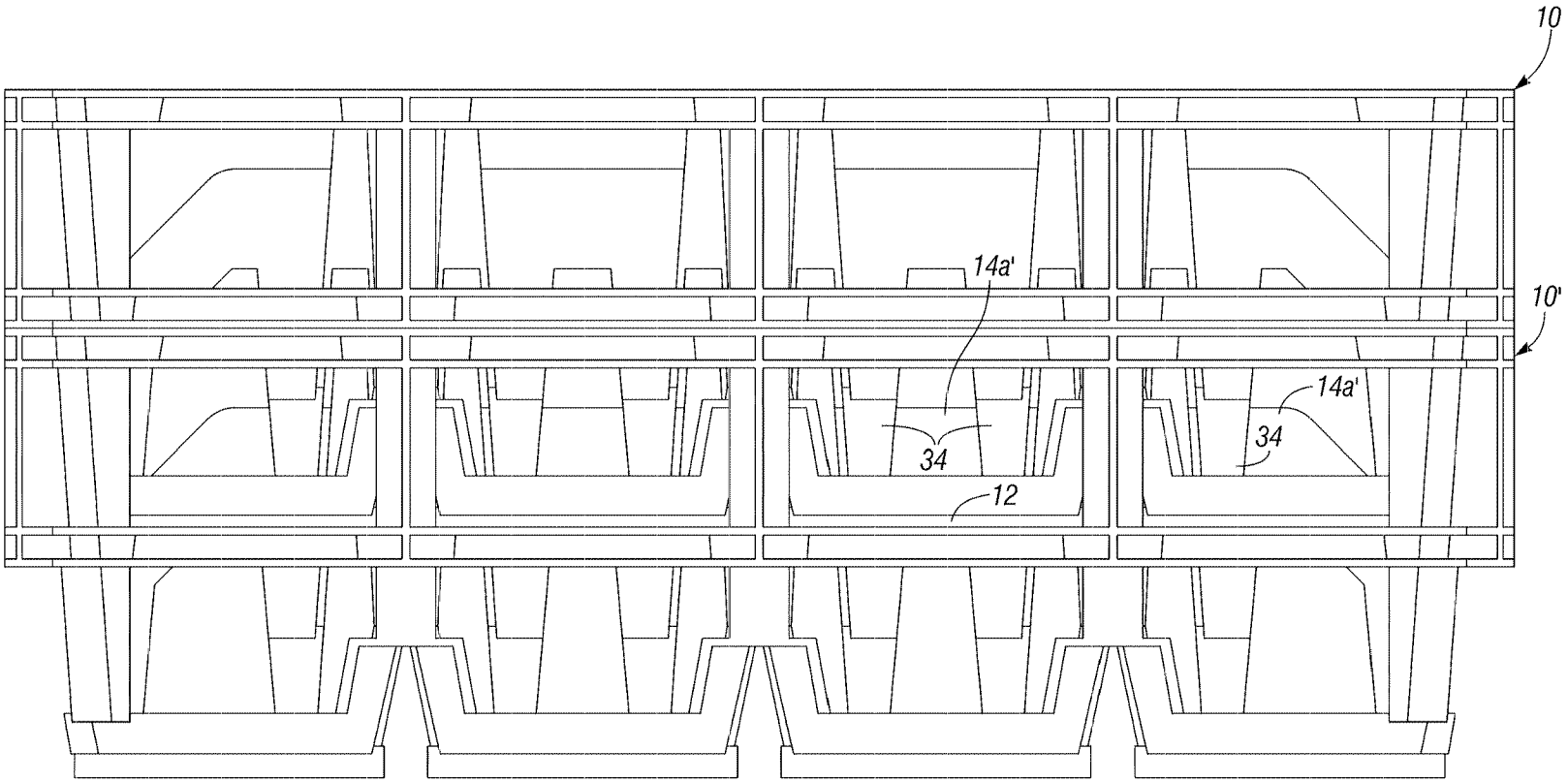
FIG. 13 is a side view of the trays of FIG. 12.

As shown in FIG. 12, when the tray 10 is empty, it can be nested with a similar tray 10' to reduce empty stacking height. In the example, the tray 10 is nested on tray 10', but it should be appreciated that many trays 10 would be stacked on one another in this manner. The side columns 22 are not vertical, but angled outwardly toward the top. Therefore, when the upper tray 10 is nested on the lower tray 10', upper portions of the columns 22' of the lower tray 10' are received toward the exterior of lower portions of the columns 22 of the upper tray 10 (i.e. below the lower band 27). The interior columns 20' of the lower tray 10' are nested within the interior columns 20 of the upper tray 10. The lateral dividers 14*b*' of the lower tray 10' are received between the pocket walls 34 of the lateral dividers 14*b* of the upper tray 10. Similarly, as can be seen in FIG. 13, the longitudinal dividers 14*a*' of the lower tray 10' are received between the pocket walls 34 of the longitudinal dividers 14*a* of the upper tray 10. The lower band 27 of the upper tray 10 rests on the upper band 25' of the lower tray 10'.

FIG. 13 is a side view of the nested trays 10, 10' of FIG. 12. As shown, when nested, the longitudinal dividers 14*a*' of the lower tray 10' are visible through the lower windows of the upper tray 10, i.e. the dividers 14' of the lower tray 10' extend upwardly higher than the base walls 12 of the upper tray 10.

Figure 14:
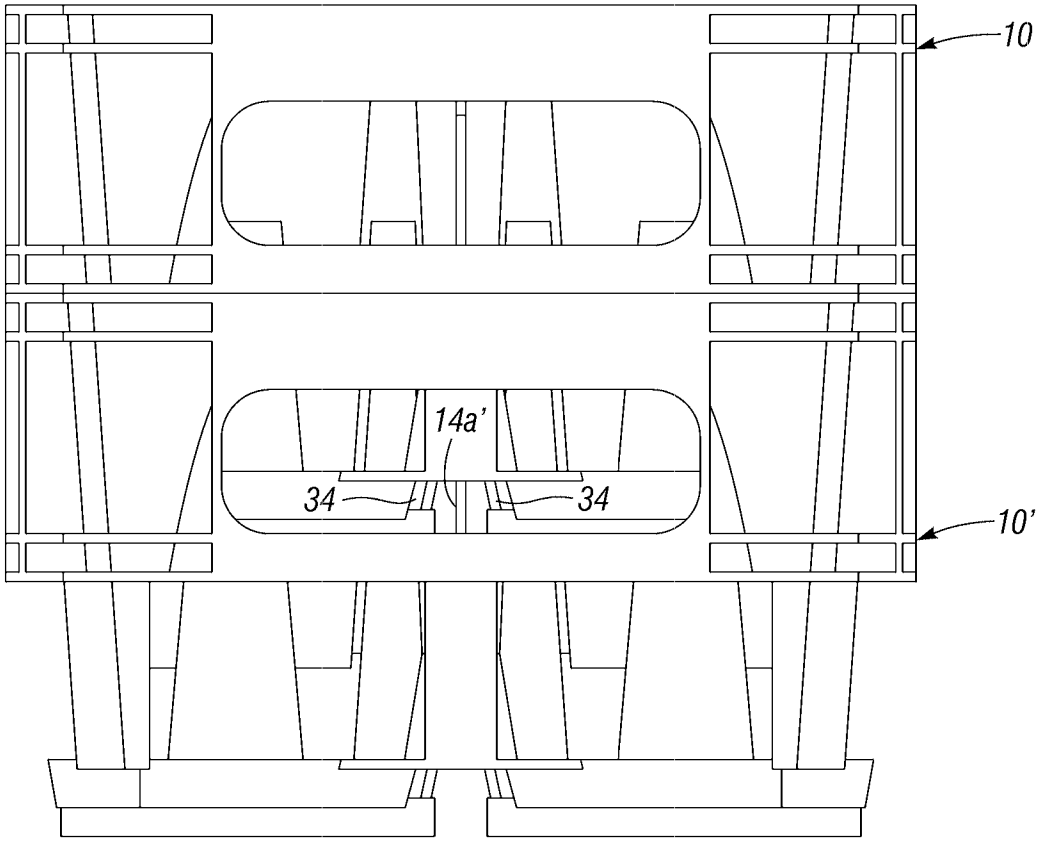
FIG. 14 is an end view of the trays of FIG. 13.

FIG. 14 is an end view of the nested trays 10, 10'. As shown, the longitudinal dividers 14*a*' of the lower tray 10' are received between the spaced apart pocket walls 34 of the upper tray 10.

Figure 15:
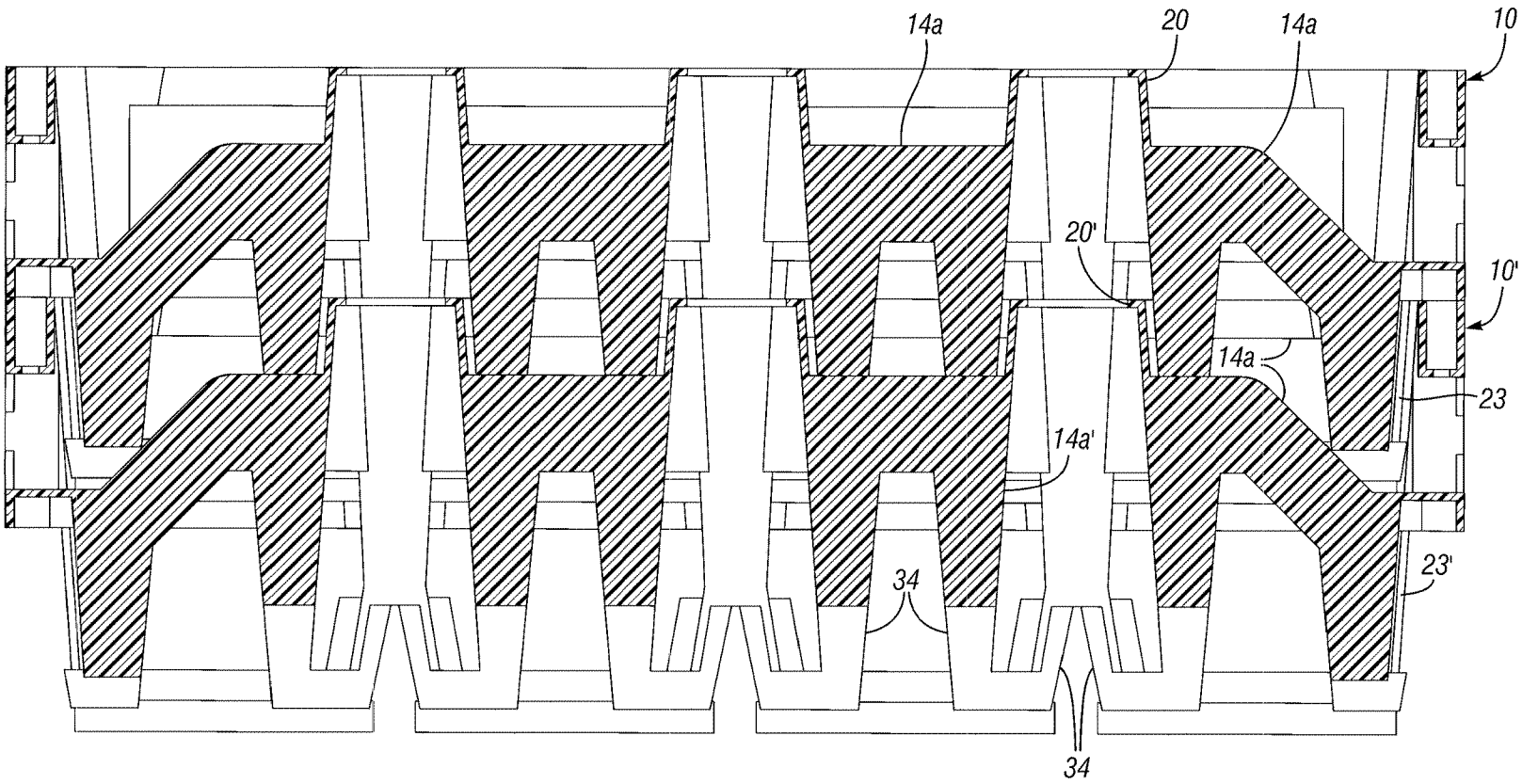
FIG. 15 is a section view taken along line 15-15 of FIG. 12.

FIG. 15 is a section view taken along line 15-15 of FIG. 12. The interior columns 20' of the lower tray 10' are received partially within the interior columns 20 of the upper tray 10. The longitudinal dividers 14*a* of the upper tray 10 are stacked on the longitudinal dividers 14*a*' of the lower tray 10 between the pocket walls 34 at the lower ends of the longitudinal dividers 14*a*.

Figure 16:
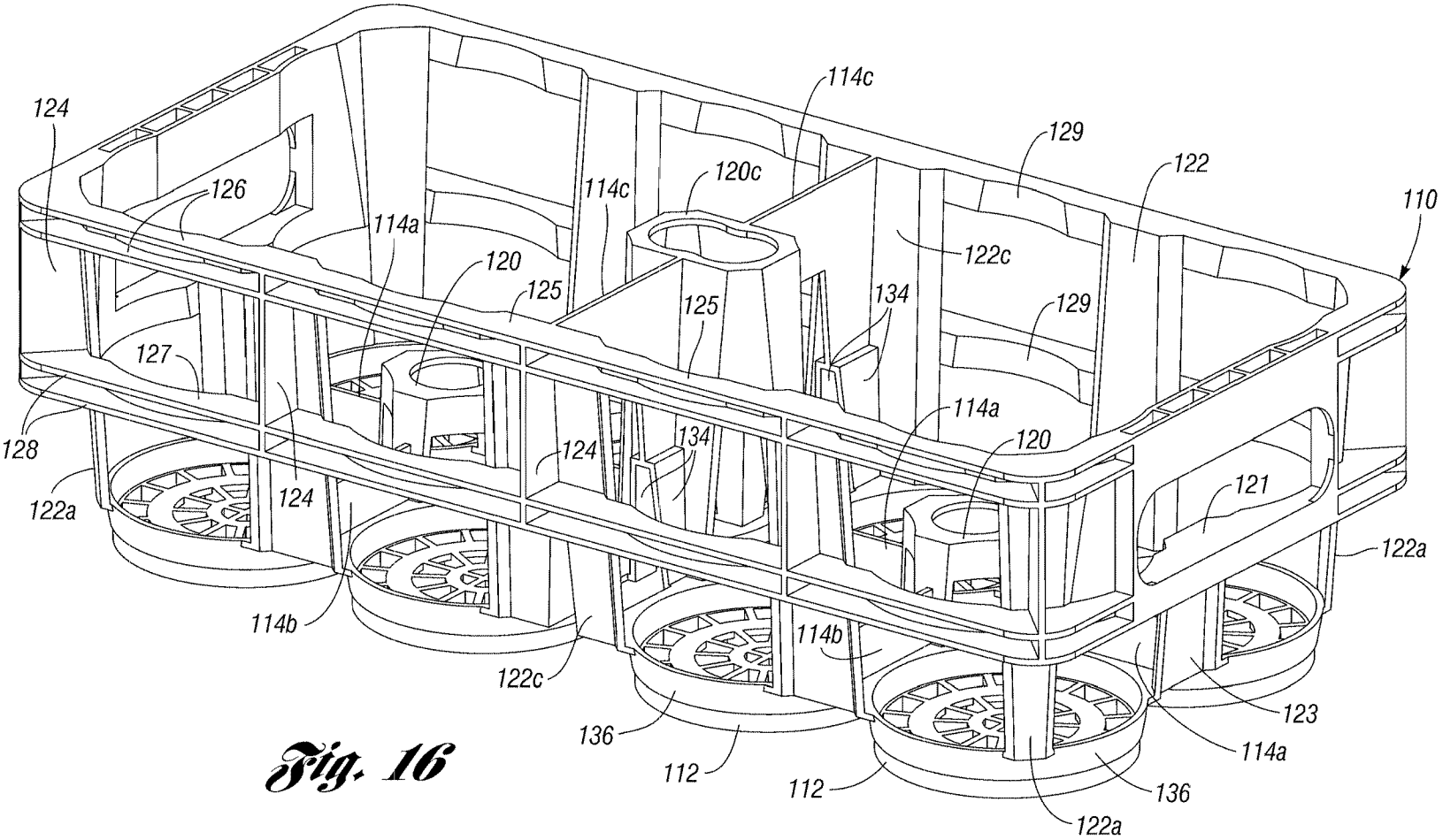
FIG. 16 is a perspective view of a tray according to a second embodiment of the present invention.

FIG. 16 is a perspective view of a tray 110 according to a second embodiment of the present invention. The tray 110 includes a plurality (in this example, eight) of base walls 112. A plurality of longitudinal dividers 114*a* and a plurality of lateral dividers 114*b*, including a pair of central lateral dividers 114*c* (collectively, "dividers 114") extend outward from a plurality of interior columns 120, including a central interior column 120*c*. The central lateral dividers 114*c* extend laterally from the central interior column 120*c*. The interior columns 120, together with the base walls 112, longitudinal dividers 114*a* and lateral dividers 114*b* define a plurality of bottle receiving pockets. The interior columns 120 are arranged generally along a longitudinal centerline of the tray 110. End longitudinal dividers 114*a* each extend from one interior column 120 to handle structures 121.

The lateral dividers 114*b* each connect one of the interior columns 120 with one of a plurality of side columns 122 positioned along a side edge of the tray 110. The side columns 122 include four corner columns 122*a* extending upwardly from the corners of the tray 110 and a pair of central exterior columns 122*c*.

The central lateral dividers 114*c* extend laterally from the central interior column 120*c* to the central exterior columns 122*c*. The central lateral dividers 114*c* are several times taller than the other lateral dividers 114*b*. In the example shown, the central lateral dividers 114*c* have an upper edge flush with an uppermost edge of the tray 110. The central interior column 120*c* is also more than twice as tall as the other interior columns 120 and in the example shown has an uppermost edge flush with the uppermost edge of the tray 110. The central column 120*c* is wider (longitudinally) than the other columns 120. Similarly, the central side columns 122*c* are wider than the other side columns 122 and include a split lower end for accommodating the central lateral dividers 114*c* of a similar tray on which the tray may be nested. This wider central interior column 120*c* and wider central side columns 122*c* put additional space between the two sets of four base walls 112, i.e. between the two sets of four bottle receiving pockets. This additional spacing permits loaded trays 110 to be cross-stacked in a known manner, with the bottles and caps always vertically aligned from layer to layer in both column and cross-stacking, which is the most stable method of stacking these type trays.

Each side column 122 includes a rear rib 124 protruding toward the exterior of the tray 110. The bottle-receiving pockets of the tray 110 are further defined by an upper band 125 and a lower band 127 along each side edge of the tray 110. The upper band 125 includes a pair of spaced-apart horizontal rib portions 126 connecting upper ends of the rear ribs 124 of the side columns 122. The lower band 127 includes a pair of spaced apart horizontal rib portions 128 connecting mid-portions of the rear ribs 124 of the side columns 122. The upper band 125 and lower band 127 each include an interior recess 129 aligned with each adjacent bottle receiving pocket. In this manner, an upper window opening is defined between the upper band 125, lower band 127 and adjacent side columns 122. A lower window opening is defined between the lower band 127, each base wall 112 and between adjacent side columns 122. The window openings increase product visibility.

The central lateral dividers 114*c* each have a lower end including two pair of spaced apart interior pocket walls 134, one of each pair connected to a different base wall 112. The base walls 112 include annular walls 136 extending about their periphery. End columns 123 connect the handle structure 121 to the annular walls 136 of the end base walls 112 and to longitudinal dividers 114*a*.

Figure 17:
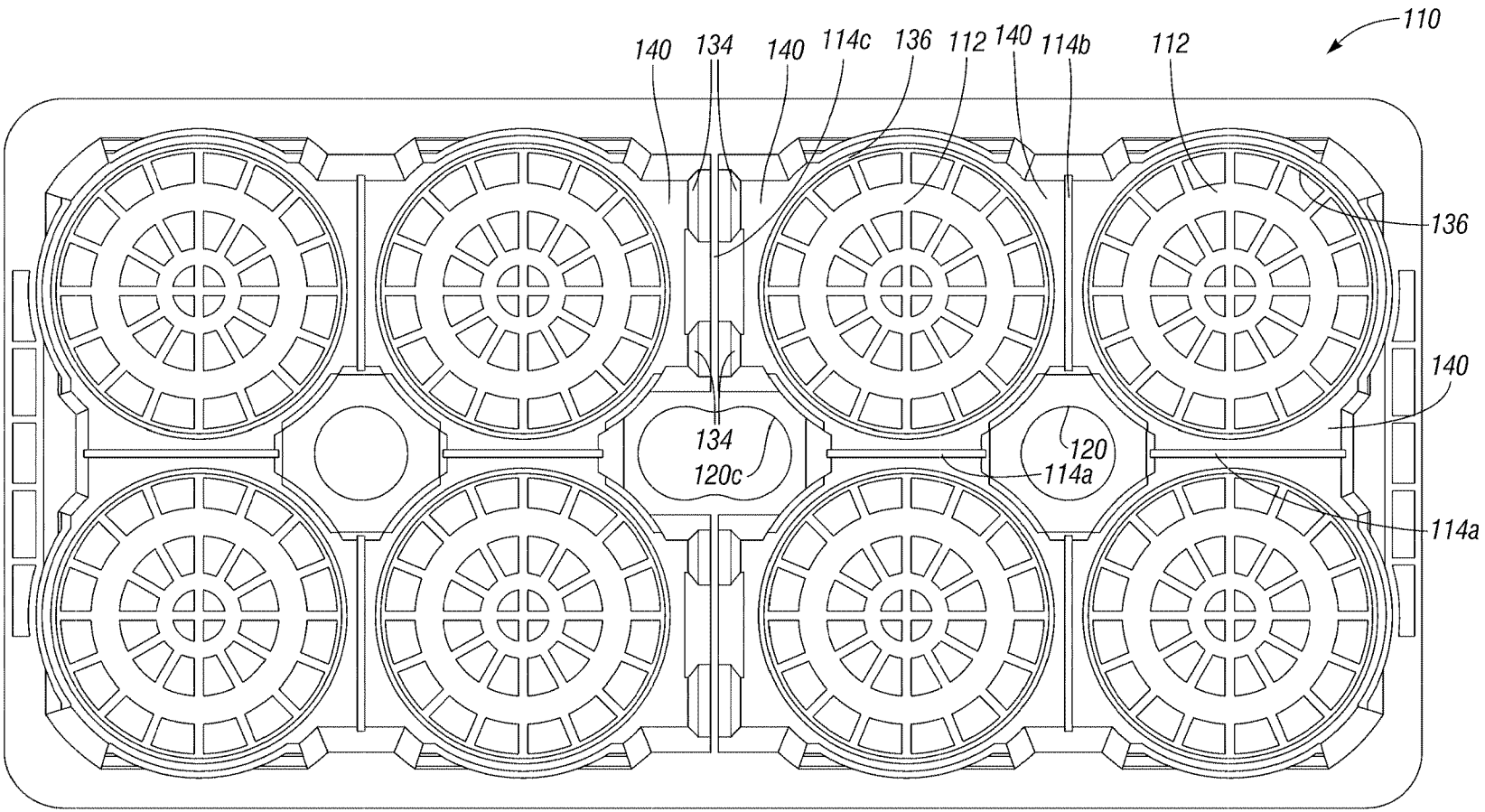
FIG. 17 is a top view of the tray of FIG. 16.

As shown in the top view of FIG. 17, lower ends of the dividers 114 each connect to a laterally diverging wall 140 (or horizontal wall 140) from which the annular walls 136 depend downwardly to the base wall 112.

Figure 18:
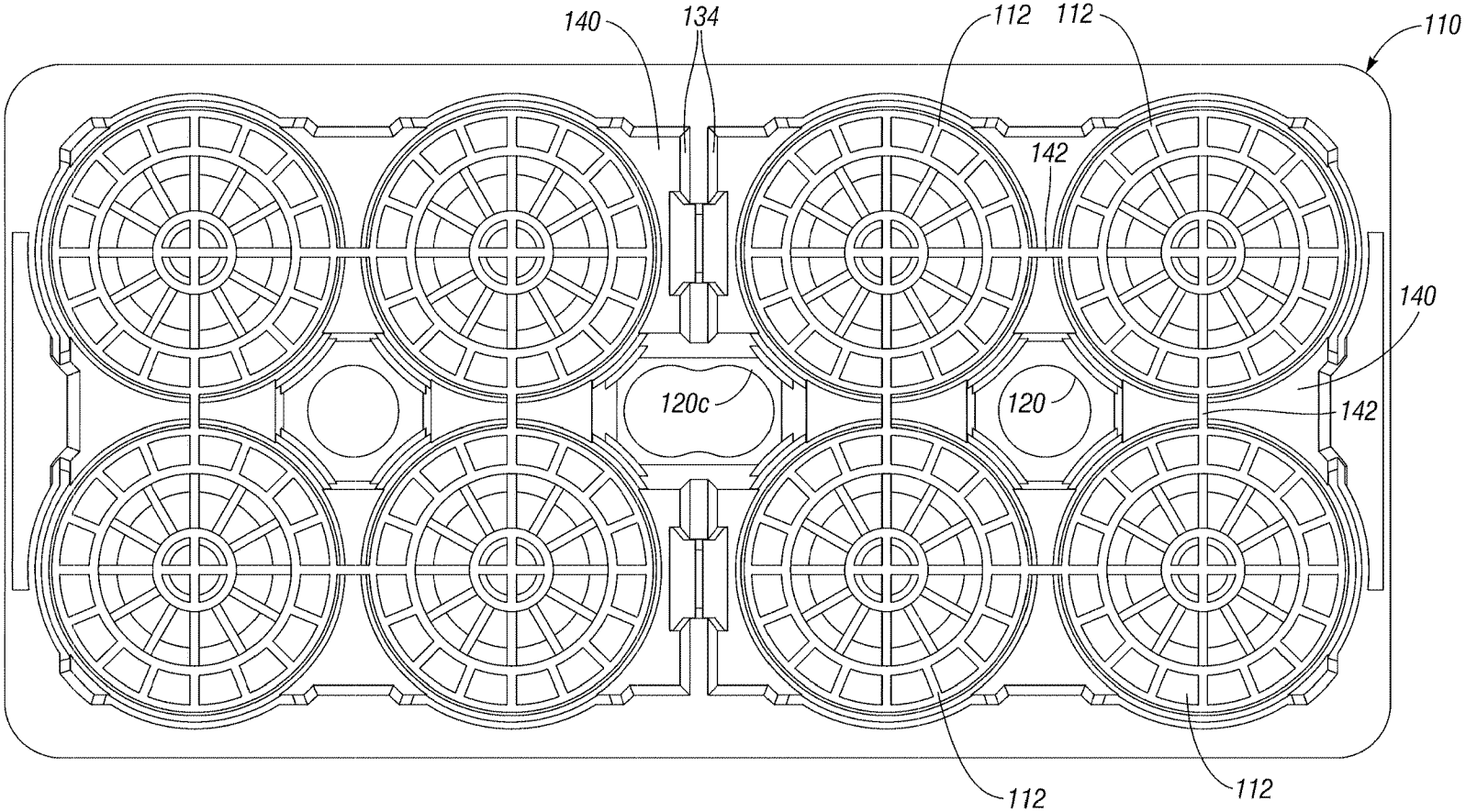
FIG. 18 is a bottom view of the tray of FIG. 16.

FIG. 18 is a bottom view of the tray 110, showing the spaced apart pocket walls 134 between the sets of four base walls 112. Within the sets of four base walls 112, the base walls 112 are connected to one another by connecting ribs 142. In this embodiment, the dividers 114 other than the central lateral divider 114*c* of one tray 110 are not received between the base walls 112 of a tray 110 nested thereon. Therefore, the adjacent base walls 112 within one of the sets of four base walls 112 can be connected to one another.

Figure 19:
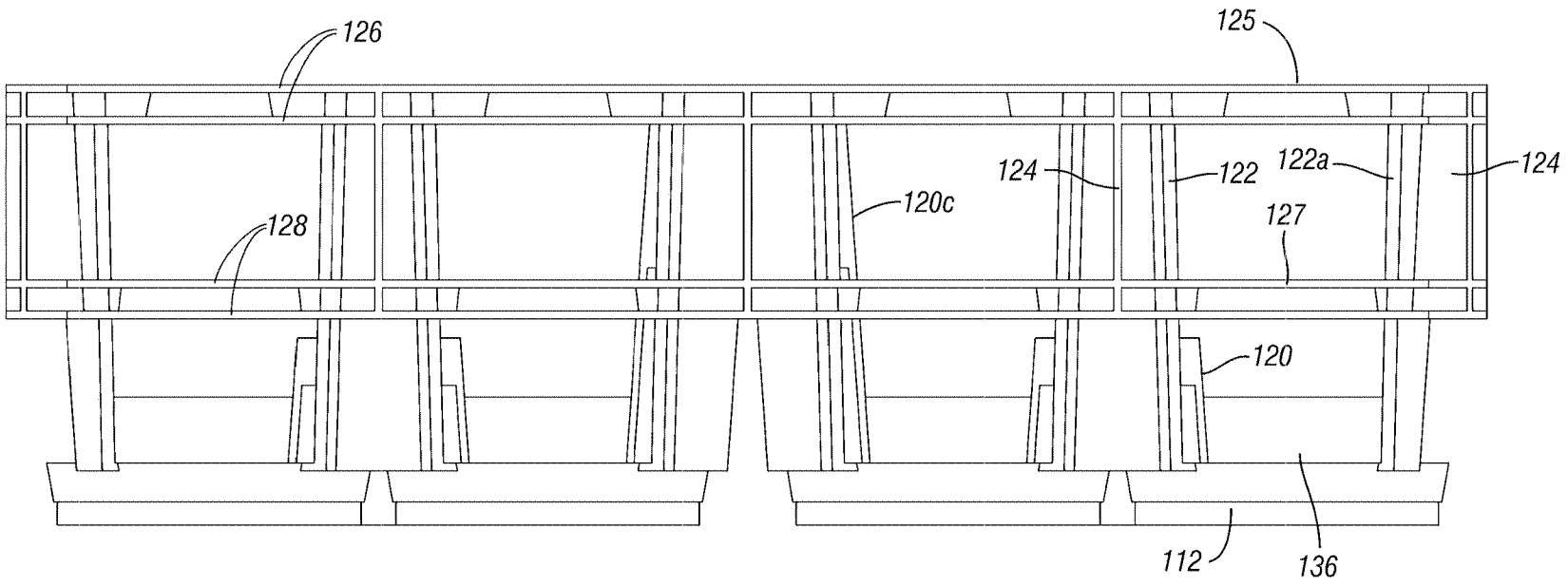
FIG. 19 is a side view of the tray.

FIG. 19 is a side view of the tray 110. Again, each side column 122 includes a rear rib 124 protruding toward the exterior of the tray 110 between the upper band 125 and the lower band 127. The horizontal rib portions 126 of the upper band 125 and horizontal rib portions 128 of the lower band 127 reinforce the side edges of the tray 110 and further define the bottle receiving pockets. The upper window openings are defined between the upper band 125, lower band 127 and adjacent side columns 122. The lower window openings are defined between the lower band 127, each base wall 112 and between adjacent side columns 122. The window openings increase product visibility, but it is not required that all of the pockets have the adjacent window openings.

Figure 20:
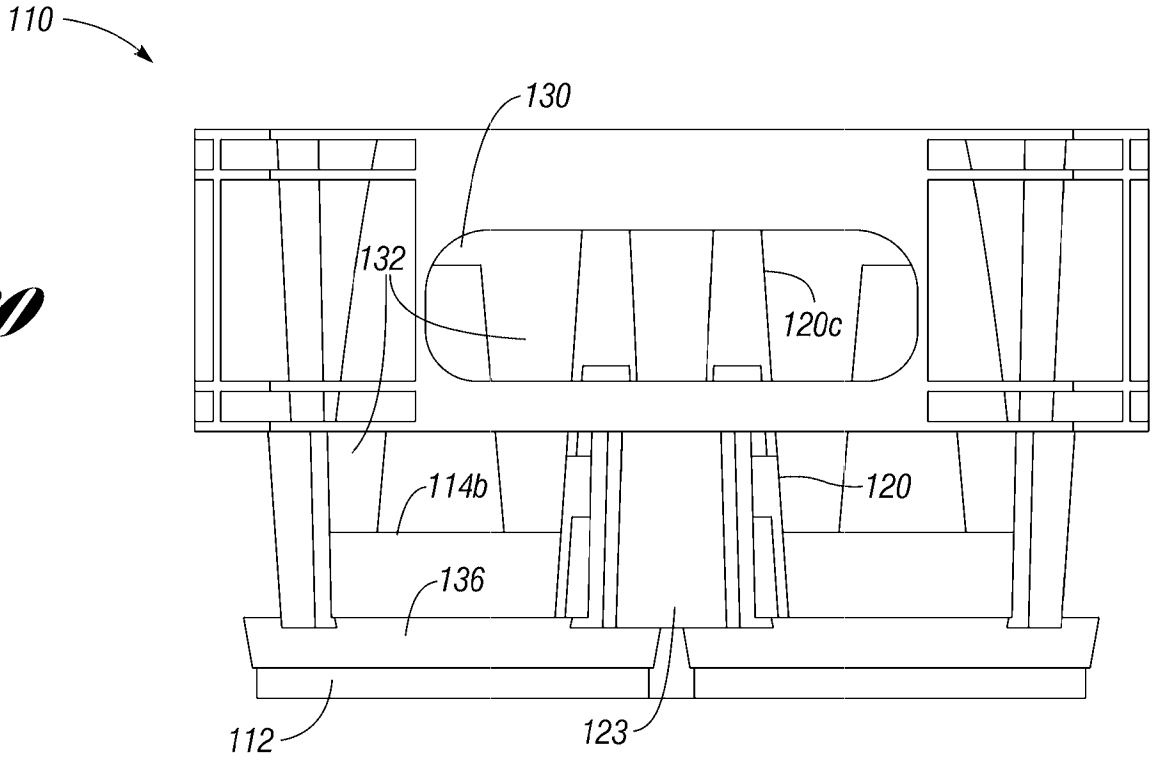
FIG. 20 is an end view of the tray.

Referring to FIG. 20, the upper portion of each of the central lateral dividers 114*c* includes a header 130 that extends directly between central side column 122*c* and the central interior column 120*c* and spaced apart leg portions 132 that are coplanar with the header portion 130. The opening formed between the leg portions 132 reduces the overall weight of the tray 110 without decreasing the rigidity, because the header portion 130 extends solidly where it is most needed. It would be possible to substitute one or more of the central lateral dividers 114*c* with solid walls or headers 130 of different sizes depending on the particular strength to weight ratio desired.

Figure 21:
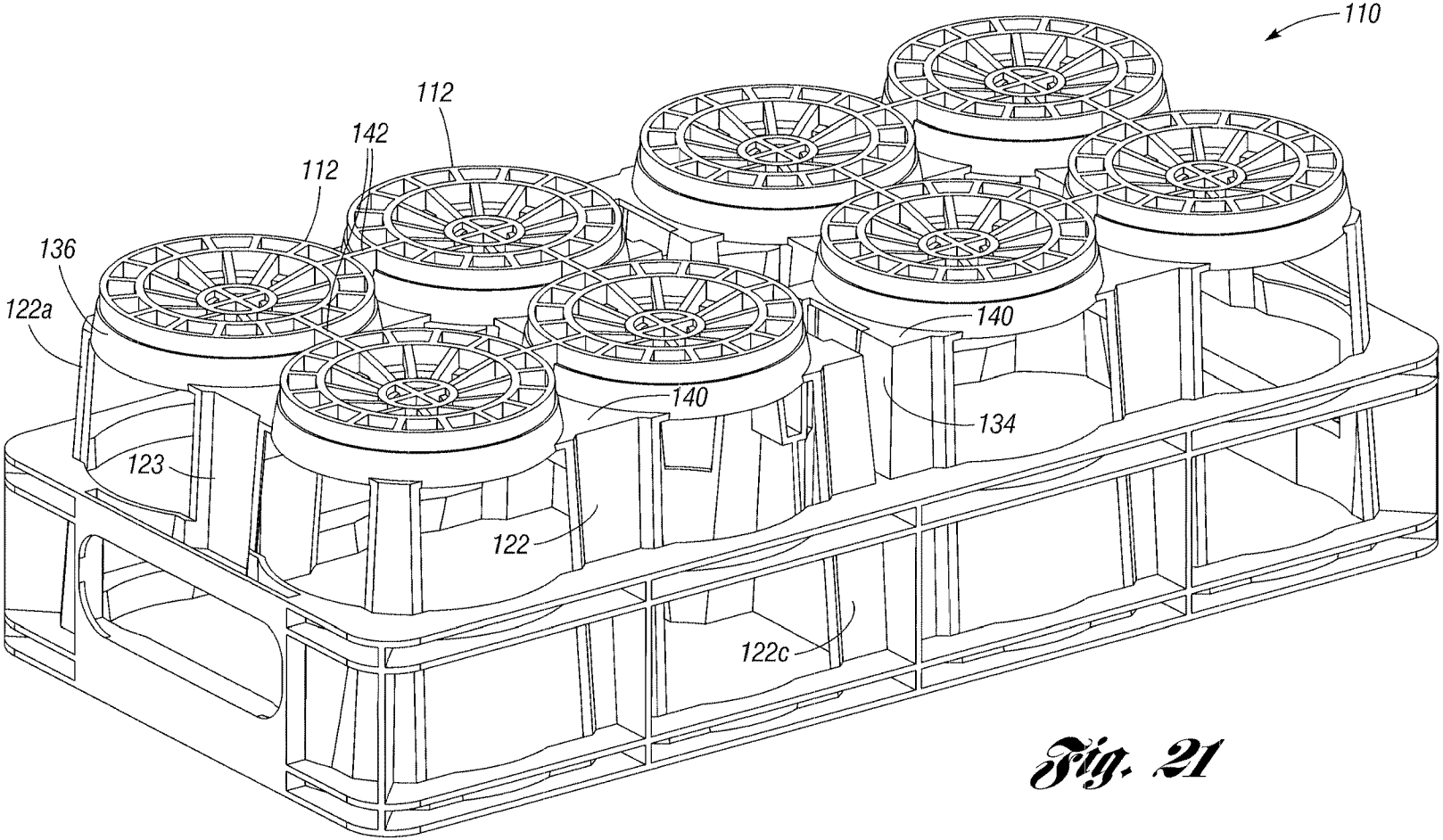
FIG. 21 is a bottom perspective view of the tray.

FIG. 21 is a bottom perspective view of the tray 110. The sets of four base walls 112 are spaced apart from one another for the purpose of receiving therebetween the central lateral dividers 114*c* of a similar tray 110 on which the tray 110 is stacked. The base walls 112 are equally-spaced in the longitudinal and lateral directions within each set of four base walls 112, but additional space lies between the sets.

Figure 22:
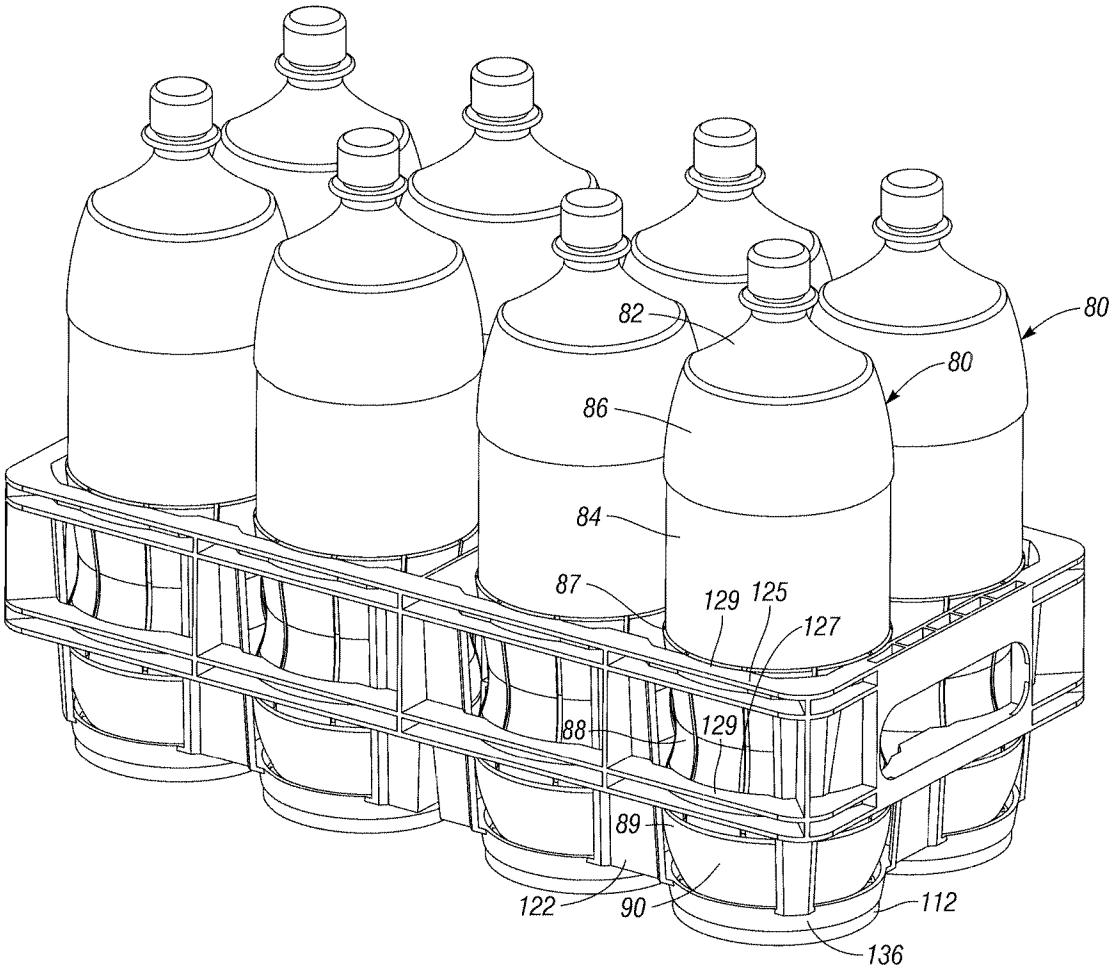
FIG. 22 is a perspective view of the tray of FIG. 16 with a plurality of bottles.

FIG. 22 is a perspective view of the tray 110 holding a plurality of the previously-described bottles 80. Although other size and shape bottles 80 may be used, the tray 110 is particularly designed to the hold multi-serving plastic bottles 80 described above, such as 2-liter plastic bottles 80.

Figure 23:
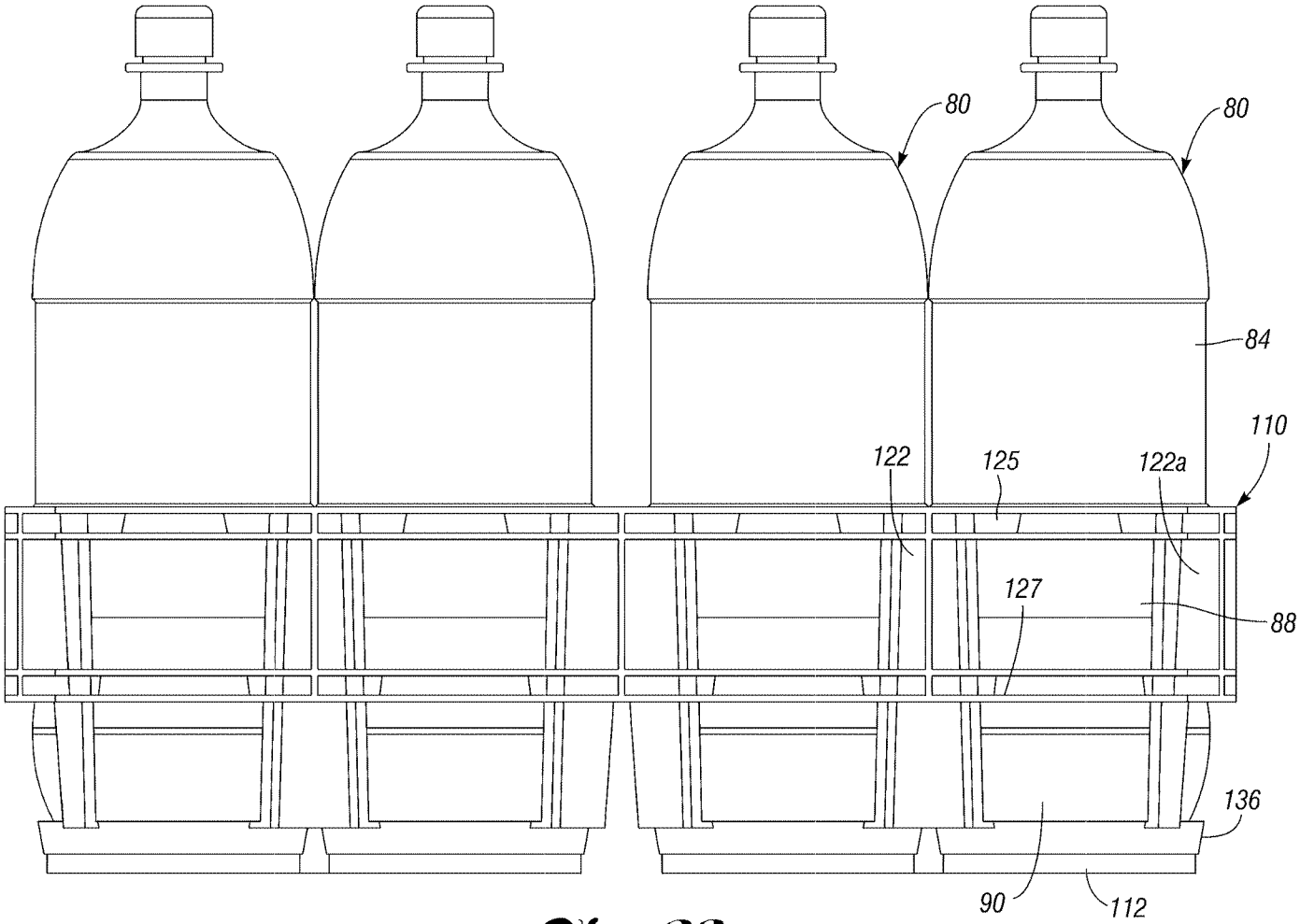
FIG. 23 is a side view of the tray and bottles of FIG. 22.

Referring to FIGS. 22 and 23, the side columns 122 are tall enough so that the side columns 122 and the upper band 125 contact the lower label bumper portion 87 of the bottles 80. The base 90 of the bottle 80 is received snugly within the pocket formed by the annular wall 136. The upper and lower window openings display the bottles 80 and expose a substantial portion of the bottles 80 for view, including the lower portion 88. Thus, stability and visibility of the bottles 80 is provided.

Figure 24:
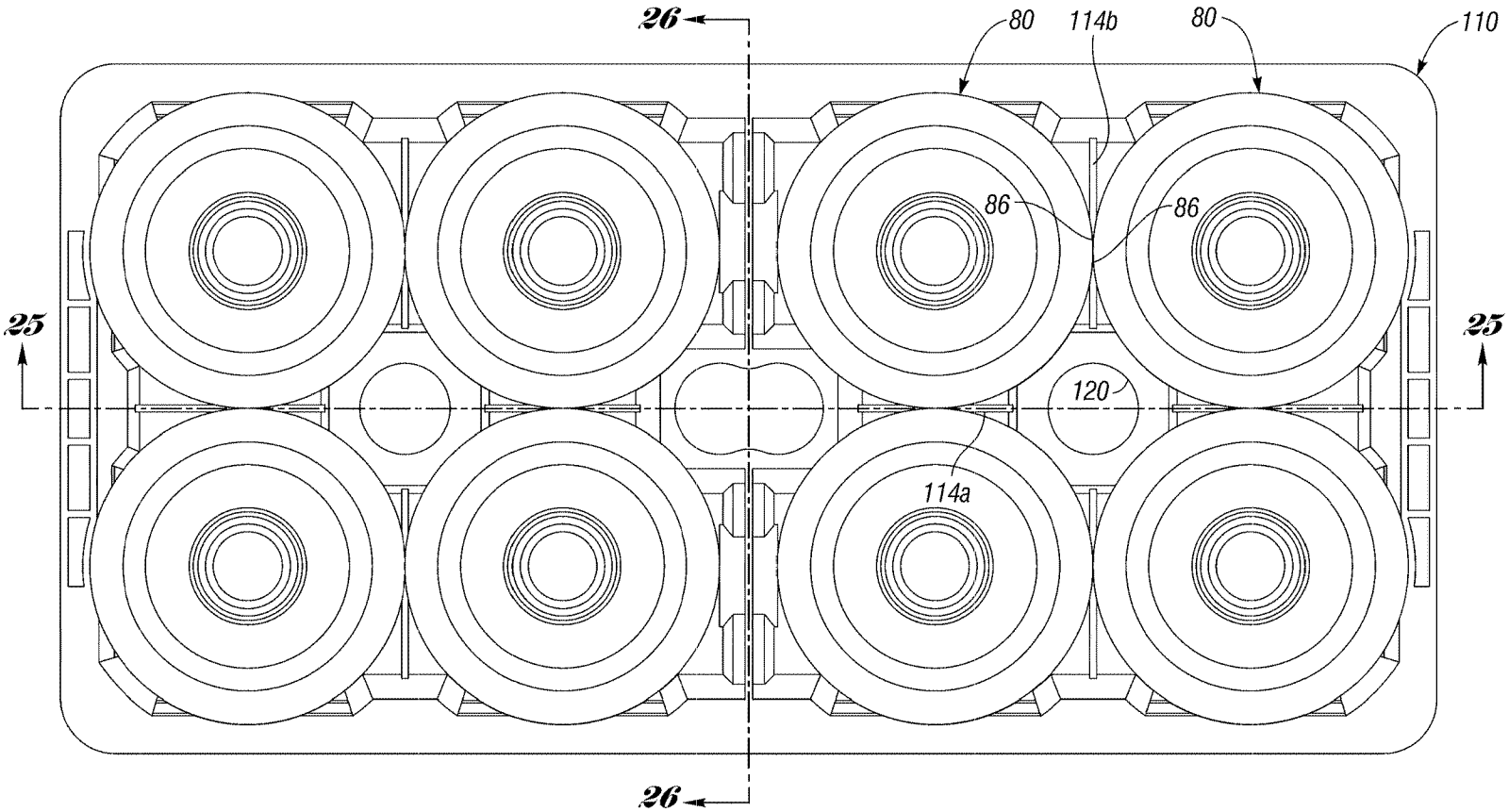
FIG. 24 is a top view of the tray and bottles of FIG. 22.
Figure 25:
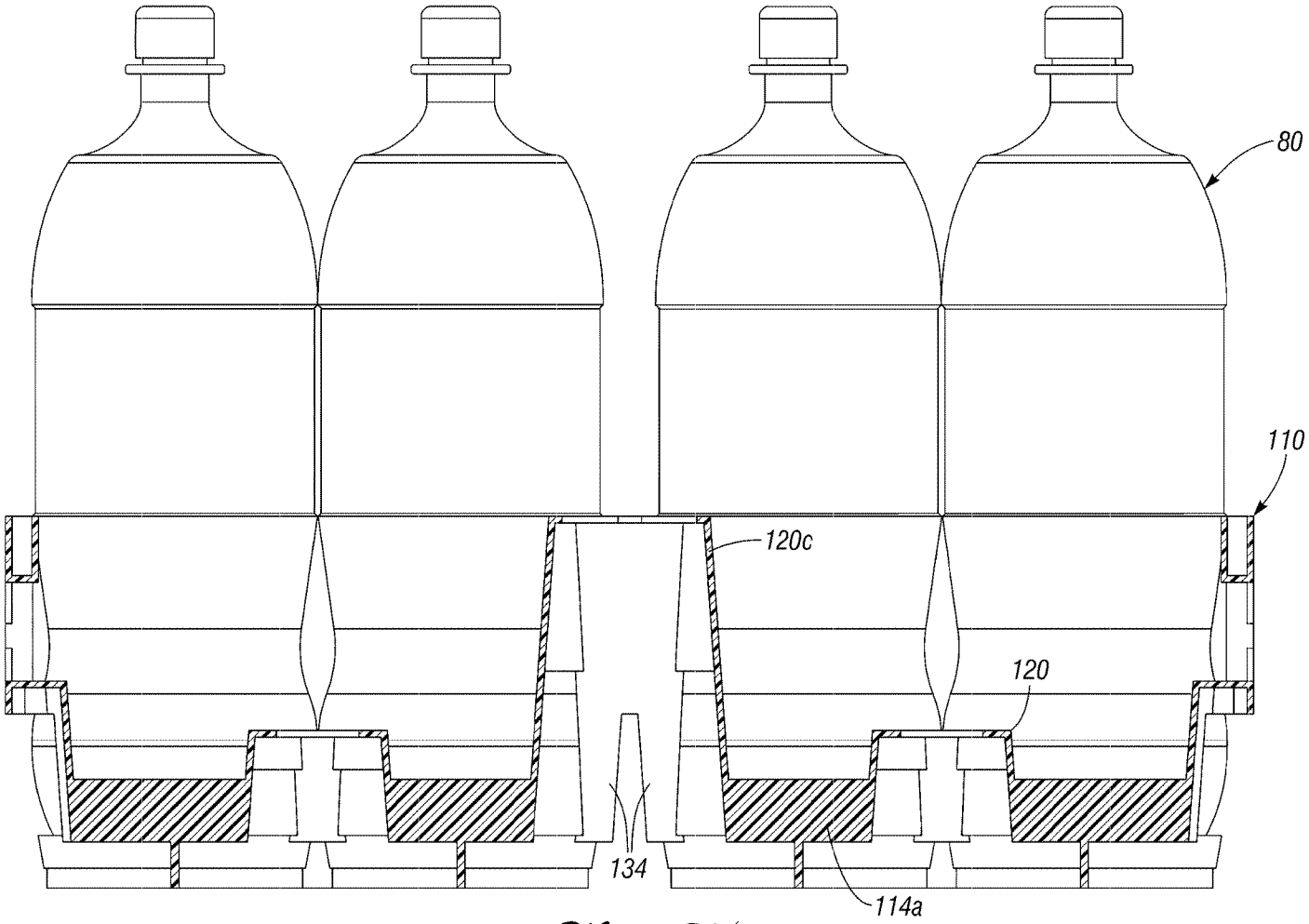
FIG. 25 is a section view taken along line 25-25 of FIG. 22.
Figure 26:
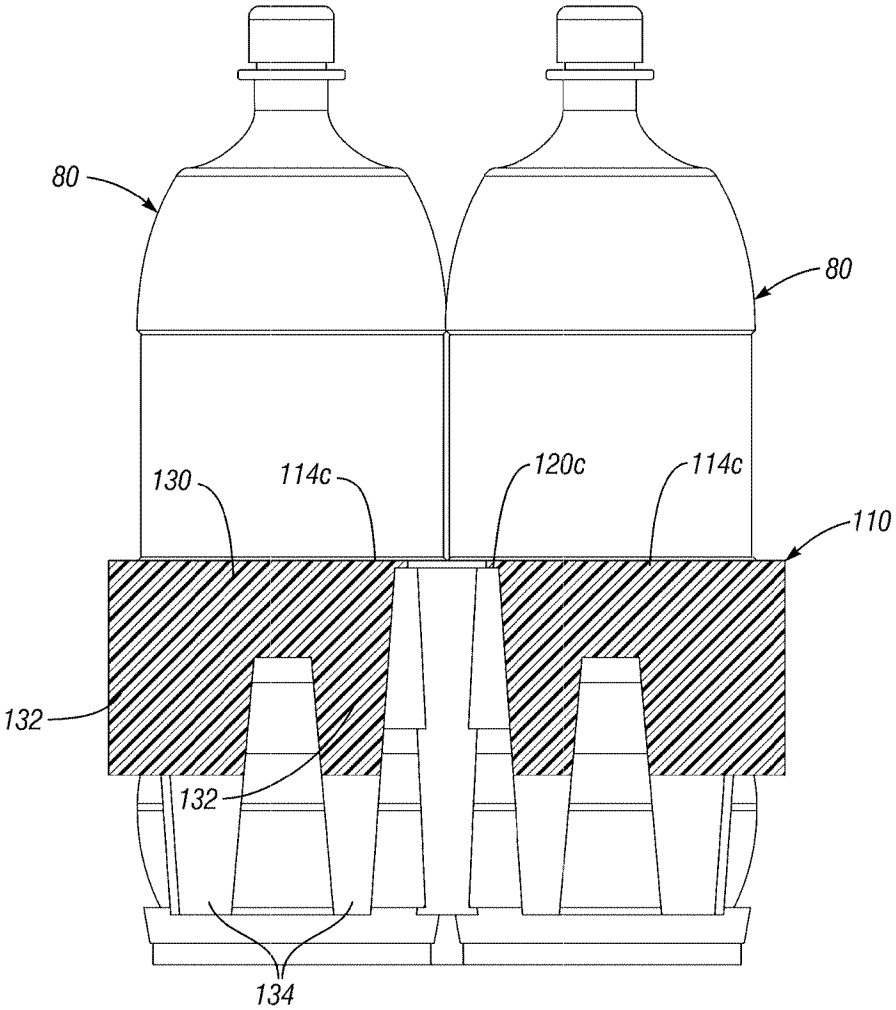
FIG. 26 is a section view taken along line 26-26 of FIG. 22.

FIG. 24 is a top view of the tray 110 and bottles 80 of FIGS. 22 and 23. As shown, the lower label bumper portions 87, upper label bumper portions 86 and heel bumpers 89 of the bottles 80 contact those of adjacent bottles 80 within the sets of four. FIG. 25 is a section view taken along line 25-25 of FIG. 24. As shown in FIG. 25, the spaced apart pocket walls 134 contact the base 90 of the bottles 80. FIG. 26 is a section view taken along line 26-26 of FIG. 24. Again, the central lateral dividers 114*c* connect to the base 112 via the pocket walls 134.

Figure 27:
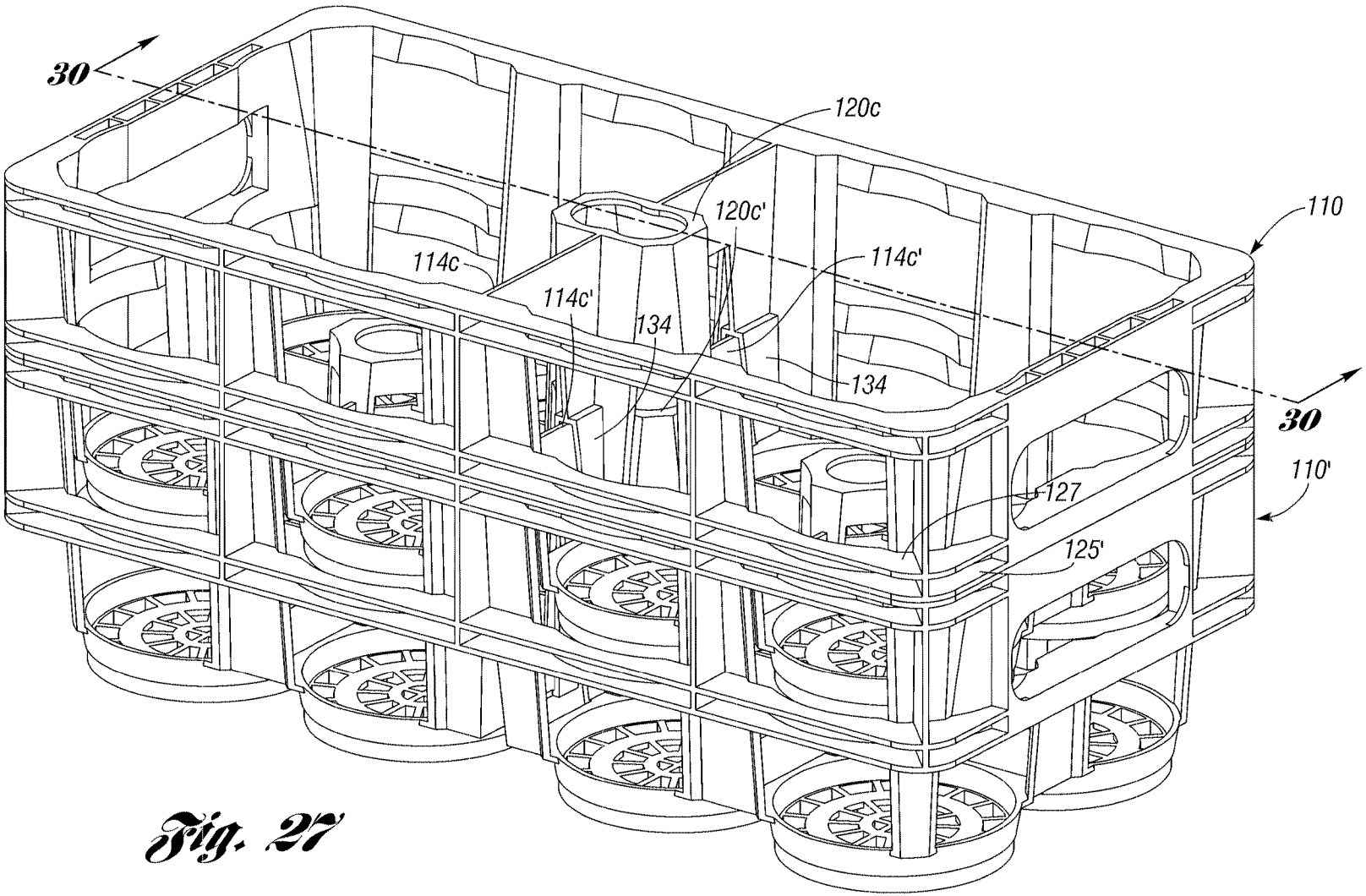
FIG. 27 is a perspective of the tray stacked on a similar tray.
Figure 28:
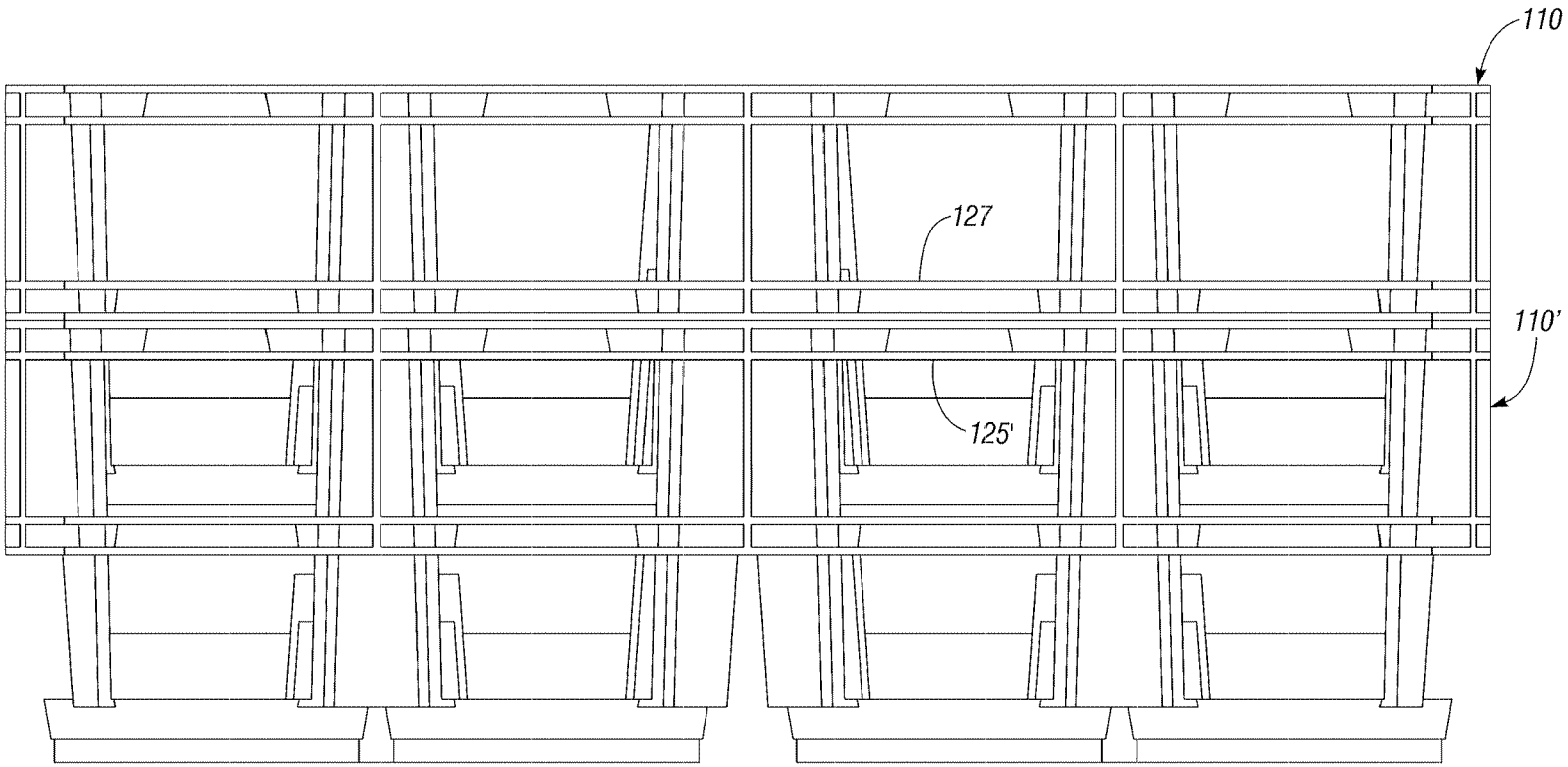
FIG. 28 is a side view of the trays of FIG. 27.
Figure 29:
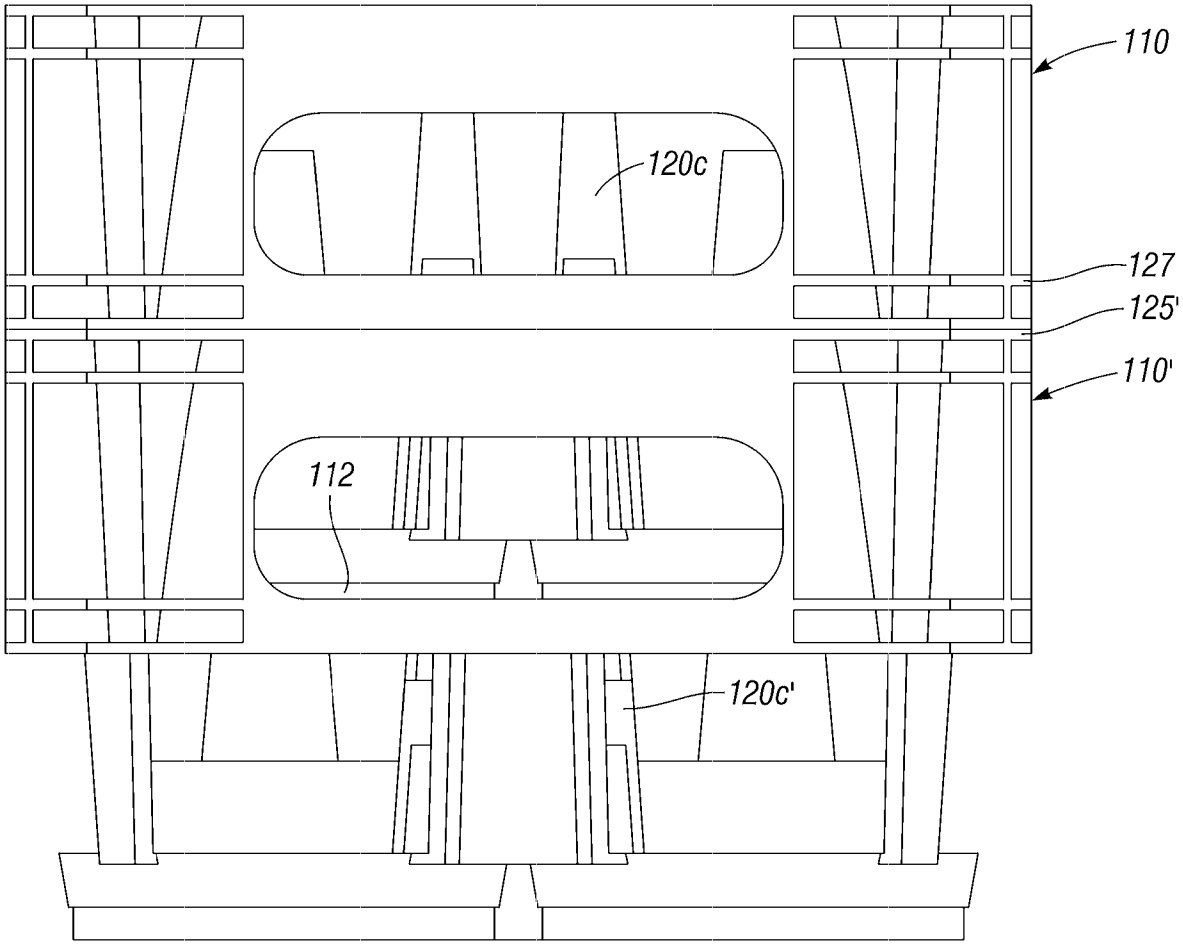
FIG. 29 is an end view of the trays of FIG. 27.

As shown in FIG. 27, when the tray 110 is empty, it can be nested with a similar tray 110' to reduce empty stacking height. In the example, the tray 110 is nested on tray 110', but it should be appreciated that many trays 110 would be stacked on one another in this manner. The side columns 122 are not vertical, but angled outwardly toward the top. Therefore, when the upper tray 110 is nested on the lower tray 110', upper portions of the columns 122' of the lower tray 110' are received toward the exterior of lower portions of the columns 122 of the upper tray 110 (i.e. below the lower band 127). The central interior column 120*c*' of the lower tray 110' is nested within the central interior column 120*c* of the upper tray 110. The central lateral dividers 114*c*' of the lower tray 110' are received between the pocket walls 134 of the lateral dividers 114*c* of the upper tray 110. The lower band 127 of the upper tray 110 rests on the upper band 125' of the lower tray 110'. FIG. 28 is a side view of the nested trays 110, 110' of FIG. 12. FIG. 29 is an end view of the nested trays 110, 110'.

Figure 30:
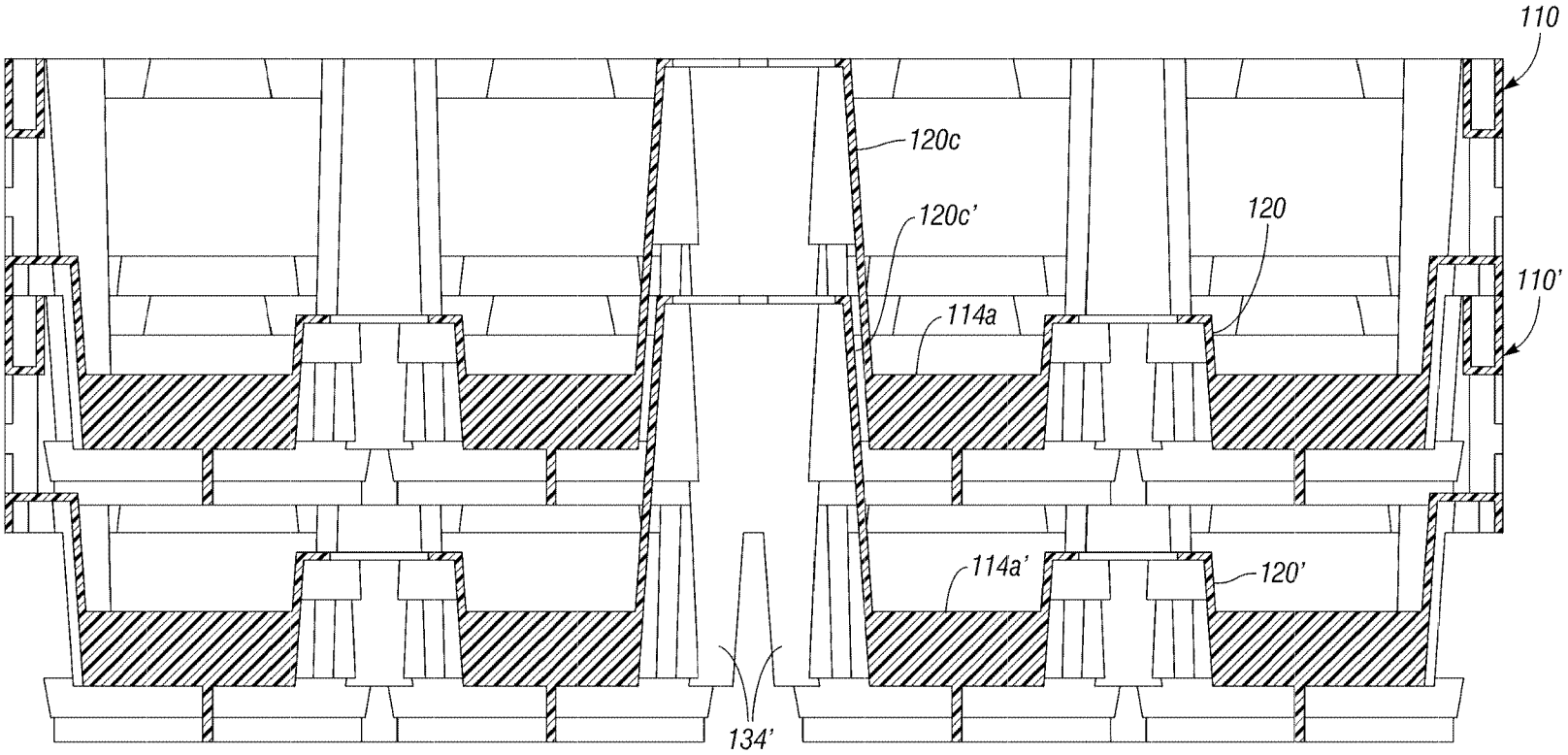
FIG. 30 is a section view taken along line 30-30 of FIG. 27.

FIG. 30 is a section view taken along line 30-30 of FIG. 27. The central interior column 120*c*' of the lower tray 110' is received partially within the central interior column 120*c* of the upper tray 110.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A tray for storing and transporting bottles comprising:

a base for supporting a plurality of bottles thereon;

a plurality of interior columns extending upwardly from the base;

a plurality of longitudinal dividers connecting the interior columns to one another;

a plurality of lateral dividers extending laterally from the interior columns, the plurality of lateral dividers and longitudinal dividers defining bottle receiving pockets on the base;

a plurality of side columns along side edges of the tray, the plurality of lateral dividers connecting the interior columns to the plurality of side columns; and an upper band extending along each of the side edges of the tray, the upper bands connecting upper ends of the plurality of side columns on the respective side edges, a window defined below the upper bands and between each adjacent pair of side columns.

2. The tray of claim 1 further including a lower band connecting the side columns to one another on each of the side edges of the tray, each lower band spaced below each upper band.

3. The tray of claim 1 wherein the base includes a plurality of spaced-apart base walls.

4. The tray of claim 3 wherein each longitudinal divider has a lower end including spaced apart pocket walls each connected to a different one of the plurality of spaced-apart base walls.

5. The tray of claim 4 wherein the pocket walls are spaced apart curved walls defining the bottle-receiving pockets.

6. The tray of claim 3 wherein the longitudinal dividers and the lateral dividers each have a lower end including spaced apart pocket walls each connected to a different one of the plurality of spaced-apart base walls.

7. The tray of claim 6 wherein the longitudinal dividers and lateral dividers are dimensioned and oriented to be received between the spaced apart pocket walls of a similar tray nested thereon.

8. The tray of claim 1 wherein a central one of the interior columns is taller than others of the plurality of interior columns.

9. The tray of claim 8 wherein the plurality of lateral dividers includes a pair of central lateral dividers that are taller than others of the plurality of lateral dividers, the central lateral dividers extending laterally from the central one of the interior columns.

10. The tray of claim 9 wherein each of the central lateral dividers has a lower end including spaced apart pocket walls each connected to a different half of the base, wherein the halves of the base are spaced apart to receive the central lateral dividers of a similar tray on which the tray is nested.

11. The tray of claim 10 wherein each of the halves of the base includes a plurality of connected base walls, each base wall defining one of the bottle-receiving pockets.

12. The tray of claim 11 wherein the central interior column of the tray receives therein the central interior column of a similar tray on which the tray is nested, and wherein the interior columns other than the central interior column do not receive therein columns of the similar tray on which the tray is nested.

13. The tray of claim 1 wherein the base includes a plurality of spaced-apart base walls each defining one of eight bottle-receiving pockets, the bottle-receiving pockets equally spaced from one another in a longitudinal direction, each longitudinal divider has a lower end including spaced apart pocket walls each connected to a different one of the plurality of spaced-apart base walls, the plurality of interior columns includes three interior columns, wherein the longitudinal dividers and lateral dividers are dimensioned and oriented to be received between the spaced apart base walls of a similar tray nested thereon.

14. The tray of claim 1 wherein four of the side columns are corner columns.

15. A tray for storing and transporting bottles comprising:

a base including a plurality of base walls for supporting a plurality of bottles thereon;

a plurality of interior columns extending upwardly from the base;

a plurality of longitudinal dividers connecting the interior columns to one another;

a plurality of lateral dividers extending laterally from the interior columns, the plurality of lateral dividers defining bottle receiving pockets on the base, wherein at least two of the lateral dividers are positioned and oriented to be received between at least two of the base walls of a similar tray nested on the tray;

a plurality of side columns along side edges of the tray, the plurality of lateral dividers connecting the interior columns to the plurality of side columns;

an upper band extending along a first side edge of the tray, the upper band connecting upper ends of the side columns on the first side edge; and a lower band connecting the side columns to one another on the first side edge, the lower band spaced below the upper band to define a window therebetween and between each adjacent pair of side columns.

16. The tray of claim 15 wherein at least one of the lateral dividers has a lower end including spaced apart pocket walls each connected to a different one of the at least two of the base walls.

17. The tray of claim 16 wherein the pocket walls are spaced apart curved walls defining the bottle-receiving pockets.

18. The tray of claim 15 wherein the longitudinal dividers and lateral dividers are dimensioned and oriented to be received between the base walls of a similar tray nested thereon.

19. The tray of claim 15 wherein a central one of the interior columns is taller than others of the plurality of interior columns.

20. A tray for storing and transporting bottles comprising:

a base including a plurality of base walls for supporting a plurality of bottles thereon;

a plurality of interior columns extending upwardly from the base;

a plurality of longitudinal dividers connecting the interior columns to one another;

a plurality of lateral dividers extending laterally from the interior columns, the plurality of lateral dividers defining bottle receiving pockets on the base, wherein at least one of the lateral dividers is positioned and oriented to be received between two of the base walls of a similar tray nested on the tray at a point at which the two of the base walls are closest to one another;

a plurality of side columns along side edges of the tray, the plurality of lateral dividers connecting the interior columns to the plurality of side columns;

an upper band extending along a first side edge of the tray, the upper band connecting upper ends of the side columns on the first side edge; and a lower band connecting the side columns to one another on the first side edge, the lower band spaced below the upper band to define a window therebetween and between each adjacent pair of side columns.

* * * * *